US007065310B2

(12) United States Patent
Maeda et al.

(10) Patent No.: US 7,065,310 B2
(45) Date of Patent: Jun. 20, 2006

(54) IMAGE FORMING APPARATUS THAT QUICKLY REMOVES OZONE PRESENT IN THE VICINITY OF A CORONA CHARGER

(75) Inventors: Masahiro Maeda, Nagano (JP); Takatomo Fukumoto, Nagano (JP); Yoichi Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/016,695

(22) Filed: Dec. 17, 2004

(65) Prior Publication Data

US 2005/0152713 A1 Jul. 14, 2005

(30) Foreign Application Priority Data

Dec. 18, 2003 (JP) ..... P2003-421222
Dec. 18, 2003 (JP) ..... P2003-421223
Dec. 18, 2003 (JP) ..... P2003-421224
Dec. 18, 2003 (JP) ..... P2003-421225

(51) Int. Cl.
*G03G 15/02* (2006.01)

(52) U.S. Cl. ..... 399/93
(58) Field of Classification Search ..... 399/93
See application file for complete search history.

(56) References Cited

FOREIGN PATENT DOCUMENTS

| | | |
|---|---|---|
| JP | 05-216321 | 8/1993 |
| JP | 06-043815 | 2/1994 |
| JP | 2000-149018 | 5/2000 |

*Primary Examiner*—Quana Grainger
(74) *Attorney, Agent, or Firm*—Hogan&Hartson LLP

(57) ABSTRACT

A corona charger is provided with a back plate which defines a first space which surrounds a discharge electrode while opening a side that the discharge electrode faces an image carrier. The back plate is formed with a first opening. A storage has a second space which stores waste toner generated in the image forming apparatus. The storage is formed with a second opening. A filter causes ozone to pass through but blocks toner. The filter is disposed between the corona charger and the second space. The first space and the second space are communicated by way of the first opening and the second opening.

15 Claims, 27 Drawing Sheets

IMAGE FORMING APPARATUS THAT QUICKLY REMOVES OZONE PRESENT IN THE VICINITY OF A CORONA CHARGER

BACKGROUND OF THE INVENTION

The present invention relates to an image forming apparatus such as a printer, a facsimile or a copying machine which forms an image by using an electrophotographic method. More particularly, the invention relates to a technique for taking a countermeasure against ozone generated from a corona charger.

In general, an image forming apparatus using an electrophotographic technique comprises: a photosensitive body having a photosensitive layer on an outer peripheral surface; a charger for uniformly charging the outer peripheral surface of the photosensitive body; an exposer for selectively exposing the uniformly charged outer peripheral surface, thereby forming an electrostatic latent image; a developer for giving a toner serving as a developing agent to the electrostatic latent image, thereby forming a visible image (a toner image); a transferer for transferring the toner image developed by the developer onto a recording medium such as paper; and a fuser for fixing the toner image formed on the recording medium with heat.

For the charger, a corona charger referred to as a scorotron charger is utilized generally.

The scorotron charger is constituted by a discharge electrode, a support member for supporting the discharge electrode, a back plate for carrying out a stable discharge, and a grid for controlling a charging potential on a photosensitive body. When actually carrying out the charging, for example, a voltage of −4 kV to −6 kV is applied to the discharge electrode, a voltage of −600 V (depending on a desired potential to be actually charged) is applied to the grid, and the back plate is set to have the same potential as that of an earth or the grid so that a corona discharge can be generated by the discharge electrode and the surface of the photosensitive body can be charged to approximately −600 V. Since such a charger can uniformly carry out the charging over the photosensitive body with a simple structure, it is widely used.

However, it has been known that such a corona charger utilizes the discharge, and therefore, a discharge product such as ozone or NOx is generated and the discharge product causes a deterioration in an image when the discharge product sticks to the photosensitive body or the charger.

Therefore, a conventional image forming apparatus is provided with an opening for sending air in the axial direction of the back face of the charger and a duct for sending the air to the back face of the charger, for example, and sends the air from one of the ends of the duct, thereby discharging ozone in the charger. Such a structure is disclosed in Japanese Utility Model Publication No. 6-43815U, for example.

Moreover, there has also been known an image forming apparatus in which a fan is provided for efficiently collecting the ozone generated by the charger from a portion between a cleaning blade and a charge removing lamp, and the fan is rotated to cause the ozone generated from the charger to flow and to deliver the same ozone to a waste toner bottle disposed in the rear portion of the apparatus through a pipe connected to the fan. The ozone is thus caused to come in contact with a waste toner stored in the waste toner bottle and is decomposed. Such a configuration is disclosed in Japanese Patent Publication No. 5-216321A.

In the case in which continuous image formation is carried out by the image forming apparatus using the corona charger, ozone is apt to remain in the vicinity of the corona charger also after the end of the image formation.

For this reason, in the conventional image forming apparatus described above, it is necessary to continuously send the air in order to discharge the ozone also after the end of the image formation.

Accordingly, there has been a problem in that a noise made by the fan or the like operated irrespective of the end of the image formation gives an unpleasant feeling to a user. Moreover, there has also been a problem in that the standby power of the apparatus is also increased, which is not preferable in respect of energy saving.

Furthermore, the ozone is heavier than the air. In an arrangement in which a charger is provided in the upper part of a photosensitive body, therefore, there has also been a problem in that an opportunity for the ozone going downward by a self-weight to come in contact with the photosensitive body is increased, resulting in the promotion of a deterioration in the photosensitive body.

On the other hand, there has been know a fuser using a pair of rollers. In such a case, when a toner image is to be fixed by the fuser, a volatile component contained in a toner is volatilized and the volatile substance is diffused to contaminate the discharge electrode of the corona charger, so that uniform discharge is hindered.

There has been known a conventional image forming apparatus comprising: a duct for sucking air containing ozone generated from a charger and feeding back the air having the ozone removed therefrom to the charger again in order to prevent the ozone generated in the charger from moving out of the image forming apparatus to attain a harmlessness; at least one fan for generating air flow in the duct; and an ozone removing member for removing the ozone in the duct. Such a configuration is disclosed in Japanese Patent Publication No. 2000-149018A. In such an image forming apparatus, the duct including the charger and the air flow generator are constituted as a closed vent path. Therefore, it is possible to prevent the volatile substance from entering the duct, therefore, the charger.

In both of the image forming apparatuses disclosed in Japanese Utility Model Publication No. 6-43815U and Japanese Patent Publication No. 5-216321A, a duct including a charger and an air flow generator are not constituted as a closed vent path. Therefore, there is an anxiety that the charger might be contaminated by a volatile substance generated in a fuser, resulting in non-uniform charging.

In both of the image forming apparatuses disclosed in Japanese Utility Model Publication No. 6-43815U and Japanese Patent Publication No. 2000-149018A, there is a possibility that the ozone might stay at the downstream side of an air flow in the corona charger and an ozone product might severely stick locally. In particular, the amount of $H_2O$ to be a carrier for a corona discharge is small after the execution of the continuous printing at a low temperature and a low humidity in a state in which the discharge electrode of the corona charger is old. Consequently, the corona discharge is apt to be unstable and the influence of the ozone product sticking is remarkable so that an image defect or a change in a density which cannot be disregarded is generated in some cases.

SUMMARY OF THE INVENTION

It is therefore an object of the invention to provide an image forming apparatus capable of quickly removing ozone present in the vicinity of a corona charger after the end of the image formation without providing an air flow generator such as a fan, or even after the provided air flow generator is deactivated.

It is also an object of the invention to provide an image forming apparatus which can prevent a corona charger from being contaminated by a volatile substance generated from a fuser and causes an image defect or a change in a density with difficulty also when carrying out continuous printing at a low temperature and a low humidity in a state in which the discharge electrode of the corona charger is old.

In order to achieve the above objects, according to the invention, there is provided an image forming apparatus, comprising:

an image carrier, on which an electrostatic latent image and a toner image are to be formed;

a corona charger, comprising:

a discharge electrode, which uniformly charges a surface of the image carrier; and a back plate, which defines a first space which surrounds the discharge electrode while opening a side that the discharge electrode faces the image carrier, the back plate being formed with a first opening;

a storage, having a second space which stores waste toner generated in the image forming apparatus, the storage being formed with a second opening; and a filter, which causes ozone to pass through but blocks toner, the filter being disposed between the corona charger and the second space;

wherein the first space and the second space are communicated by way of the first opening and the second opening.

With the above configuration, it is possible to quickly remove the ozone present in the vicinity of the corona charger after the end of the image formation without providing any air flow generator. As a result, it is possible to prevent a noise from being made by the air flow generator after the end of the image formation and to contribute to energy saving.

Since the filter does not cause the toner to pass therethrough, the waste toner in the storage can be prevented from passing through the filter toward the corona charger and the image carrier. Accordingly, the corona charger and the photosensitive body can be prevented from being contaminated by the waste toner.

When a humidity around the corona charger is relatively high, the water content passes through the filter and is adsorbed into the waste toner in the storage. To the contrary, when the humidity around the corona charger is relatively low, the water content (the moisture) adsorbed into the waste toner is released and is supplied around the corona charger through the filter.

Therefore, even in the case where continuous printing is carried out at low temperature and low humidity in a state that the discharge electrode of the corona charger is old, the discharge is stabilized by the water content supplied from the storage so that an image defect or a change in a density is hardly caused.

Preferably, the storage is arranged below the corona charger, and the corona charger is arranged below the image carrier.

With the above configuration, even if ozone remains in the vicinity of the corona charger after the image forming operation, the ozone moves downward by self-weight thereof. Specifically, the ozone in the corona charger passes through the first opening and moves downward to the storage through the filter. Since the toner has ozone adsorbing property, the ozone entering the storage is quickly adsorbed by the waste toner. Moreover, a chance for the ozone to come in contact with the image carrier can be eliminated, thereby prolonging the lifetime of the image carrier.

Preferably, the image carrier, the corona charger and the storage are integrated in a single cartridge body.

In this case, by causing the replacement timings of the image carrier, the corona charger and the storage to be coincident with each other. Therefore, it is possible to prevent a situation that the image carrier and the corona charger fall on the end of the lifetime when the waste toner is not present in the toner storage.

Alternatively, the storage may be configured to be replaceable independently from the image carrier and the corona charger. Here, the filter is disposed so as to close the second opening.

In this case, the filter can be periodically replaced in accordance with the replacement of the storage, so that an almost constant vent efficiency can be maintained.

Preferably, an agitator is disposed in the storage to agitate the waste toner stored therein.

In this case, it is possible to renew the surface of the waste toner in the storage. Thus, it is possible to obtain ozone adsorbing effect and a water content adsorbing and releasing effect efficiently and continuously.

Here, it is preferable that the agitator is disposed in the vicinity of the second opening.

In this case, ozone passing through the second opening can be adsorbed more quickly by waste toner stuck to the agitator.

Preferably, the corona charger is disposed in a duct, and the duct is formed with a third opening. An air flow generator generates air flow in the duct. The duct and the second space are communicated by way of the second opening and the third opening. The filter is disposed between the duct and the second space.

With this configuration, ozone generated in the vicinity of the corona charger during the image formation is quickly discharged by the air flow flowing in the duct. In addition, a part of the air flow flows into the first space from the first opening so that the ozone present in the first space is discharged quickly. Further, a part of the air flow enters the storage from the duct, and returns from the storage to the duct.

Here, it is preferable that the storage is arranged below the duct. In this case, the ozone remaining in the vicinity of the corona charger moves downward by self-weight thereof through the first opening, the duct and the filter, even in the case where the air flow generator is deactivated after the image formation.

It is also preferable that the filter is elongated in a direction of the air flow. A dimension of the filter in a direction perpendicular to the direction of the air flow is made larger in a downstream side of the air flow.

It is further preferable that the first opening is elongated in the direction of air flow. A dimension of the first opening in the direction perpendicular to the direction of the air flow is made larger in a downstream side of the air flow.

Ozone is apt to stay on the downstream side of the air flow in the vicinity of the corona charger. With the above configuration, however, the ozone which is apt to stay on the downstream side can be caused to quickly move to the storage through the first opening and the filter, and the ozone is thereby adsorbed into a waste toner T.

It is also preferable that the duct is configured to form a closed circulation path.

In this case, a foreign substance such as a volatile substance generated from the fuser unit will not enter the duct. Even if the foreign substance enters the duct, an amount thereof is very small. Consequently, it is possible to prevent the corona charger from being contaminated by the foreign substance such as the volatile substance generated from the fuser unit. Thus, it is possible to obtain a uniform charging condition.

It is further preferable that an ozone remover is disposed in the duct. In this case, the ozone in the ventilation path can be removed more positively.

Preferably, the discharge electrode is a saw-toothed electrode. In this case, since an ozone generation concentration (the amount of generation) is reduced, it is not necessary to provide any ozone remover in the duct.

It is also preferable that the second opening and the third opening are arranged so as not to oppose to the first opening.

In this case, the air flow in the first space is stabilized, thereby more stable charging condition can be obtained.

Alternatively, the second opening may be arranged so as to oppose to the first opening to enhance the ozone removability.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiment of the invention will be described below in detail with reference to the accompanying drawings.

Figure 1:
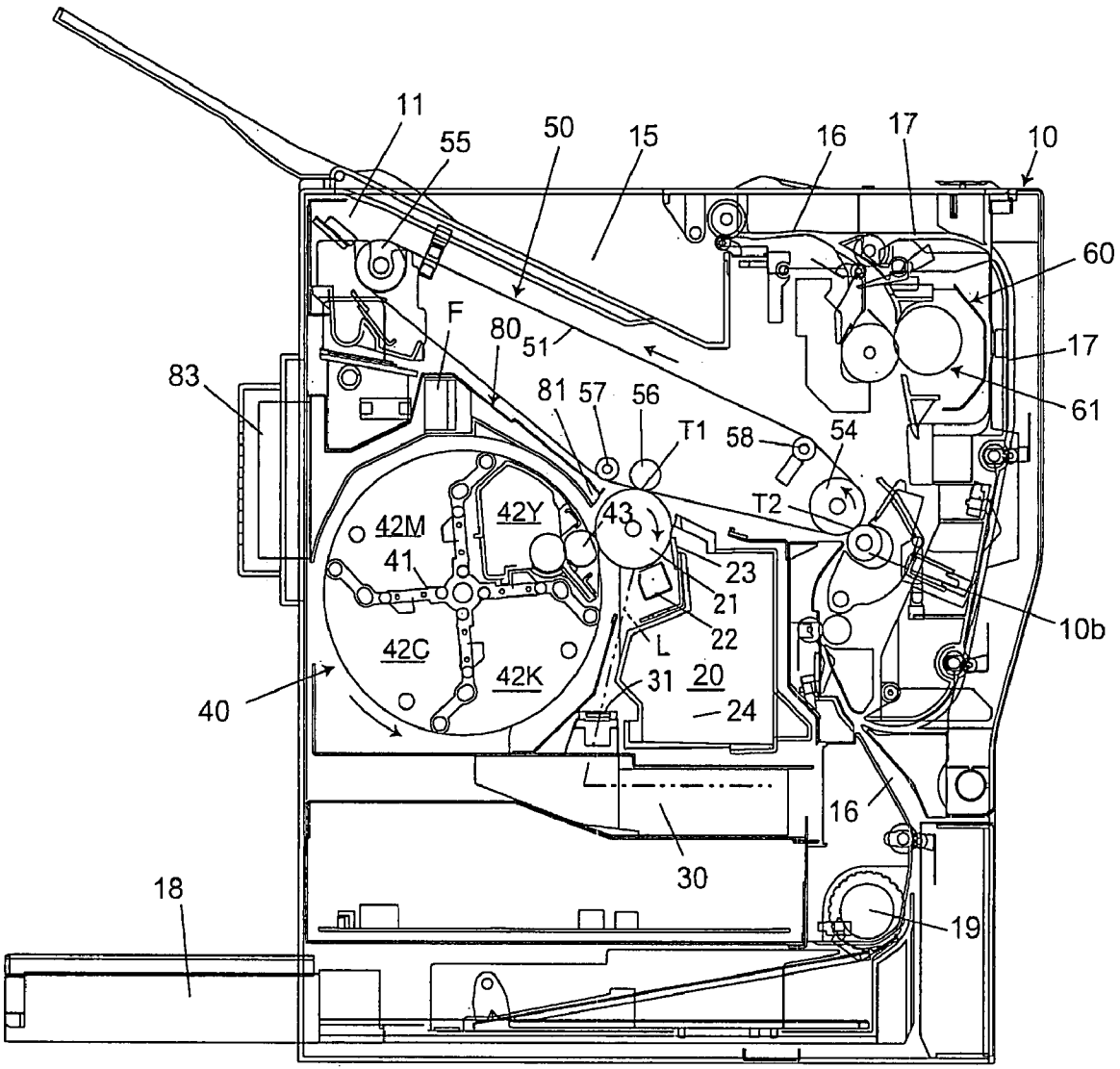
FIG. 1 is a schematic section view of an image forming apparatus according to a first embodiment of the invention.

An image forming apparatus according to a first embodiment of the invention is a color image forming apparatus capable of forming a full color image on both surfaces of paper (recording material) having an A3 size. As shown in FIG. 1, the image forming apparatus comprises: a casing body 10; an image carrier unit 20 accommodated in the casing body 10; an exposer unit 30; a developer unit 40; an intermediate transfer unit 50; and a fuser unit 60.

The casing body 10 is provided with a frame (not shown) of an apparatus body, and each unit is attached to the frame.

The image carrier unit 20 comprises: a photosensitive body (an image carrier) 21 having a photosensitive layer on an outer peripheral surface; and a corona charger (a scorotron charger) 22 for uniformly charging the outer peripheral surface of the photosensitive body 21. The outer peripheral surface of the photosensitive body 21 charged uniformly by the corona charger 22 is selectively exposed with a laser beam L emitted from the exposer unit 30 to form an electrostatic latent image thereon, and a toner serving as a developing agent is given to the electrostatic latent image by the developer unit 40 to form a visible image (a toner image). The toner image is primarily transferred to an intermediate transfer belt 51 of the intermediate transfer unit 50 at a primary transfer portion T1, and is secondarily transferred onto a recording medium such as paper at a secondary transfer portion T2.

The image carrier unit 20 further comprises: a cleaning blade (cleaner) 23 for removing a toner remaining on the surface of the photosensitive body 21 after the primary transfer is performed; and a waste toner storage 24 for accommodating waste toner removed by the cleaner 23.

In the casing body 10, there are provided a delivery path 16 for delivering paper having an image formed on one of surfaces at the secondary transfer portion T2 toward an ejection tray 15 provided on the upper face of the casing body 10, and a return path 17 for switching back the paper delivered toward the ejection tray 15 through the delivery path 16 and returning the same paper toward the secondary transfer portion T2 in order to form an image on the other surface.

In the lower part of the casing body 10, there are provided a feeding tray 18 for storing sheets of paper in a stacking manner and a feeding roller 19 for feeding the paper toward the secondary transfer portion T2 one by one.

The developer unit 40 is a rotary developer unit in which a plurality of developer cartridges respectively accommodating toner are removably attached to a rotor body 41. In the embodiment, there are provided a developer cartridge 42Y for yellow, a developer cartridge 42M for magenta, a developer cartridge 42C for cyan and a developer cartridge 42K for black (only the developer cartridge 42Y for yellow is directly shown in the drawing), and the rotor body 41 is rotated at a pitch of 90 degrees in the direction of an arrow so that a developing roller 43 can be selectively caused to abut on the photosensitive body 21 to selectively develop the surface of the photosensitive body 21.

The exposer unit 30 serves to irradiate the laser beam L from an exposing window 31 constituted by a plate glass toward the photosensitive body 21.

The intermediate transfer unit 50 includes a unit frame which is not shown, a driving roller 54 supported rotatably by the frame, a driven roller 55, a primary transfer roller 56, a guide roller 57 for stabilizing the state of the belt 51 at the primary transfer portion T1, a tension roller 58, and the intermediate transfer belt 51 provided over these rollers, and the belt 51 is circulated in the direction of an arrow. The primary transfer portion T1 is formed between the photosensitive body 21 and the primary transfer roller 56, and the secondary transfer portion T2 is formed in a pressure contact portion between the driving roller 54 and a secondary transfer roller 10*b* provided on the casing body side.

The secondary transfer roller 10*b* is retractably comes in contact with the intermediate transfer belt 51 so as to form the secondary transfer portion T2 together with the driving roller 54.

When forming a color image, toner images having a plurality of colors are superposed on the intermediate transfer belt 51 in a state that the secondary transfer roller 10*b* is retracted from the intermediate transfer belt 51, and thereafter, the secondary transfer roller 10*b* abuts on the intermediate transfer belt 51 and paper is supplied thereto so that a color toner image is transferred onto the paper.

The paper having the toner image transferred thereto passes through a heating roller pair 61 of the fuser unit 60 so that a toner image is fused and fixed, and the same paper is ejected toward the ejection tray 15.

The fuser unit 60 is constituted by a non-oil type fuser which does not coat the heating roller 61 with oil.

Figure 2:
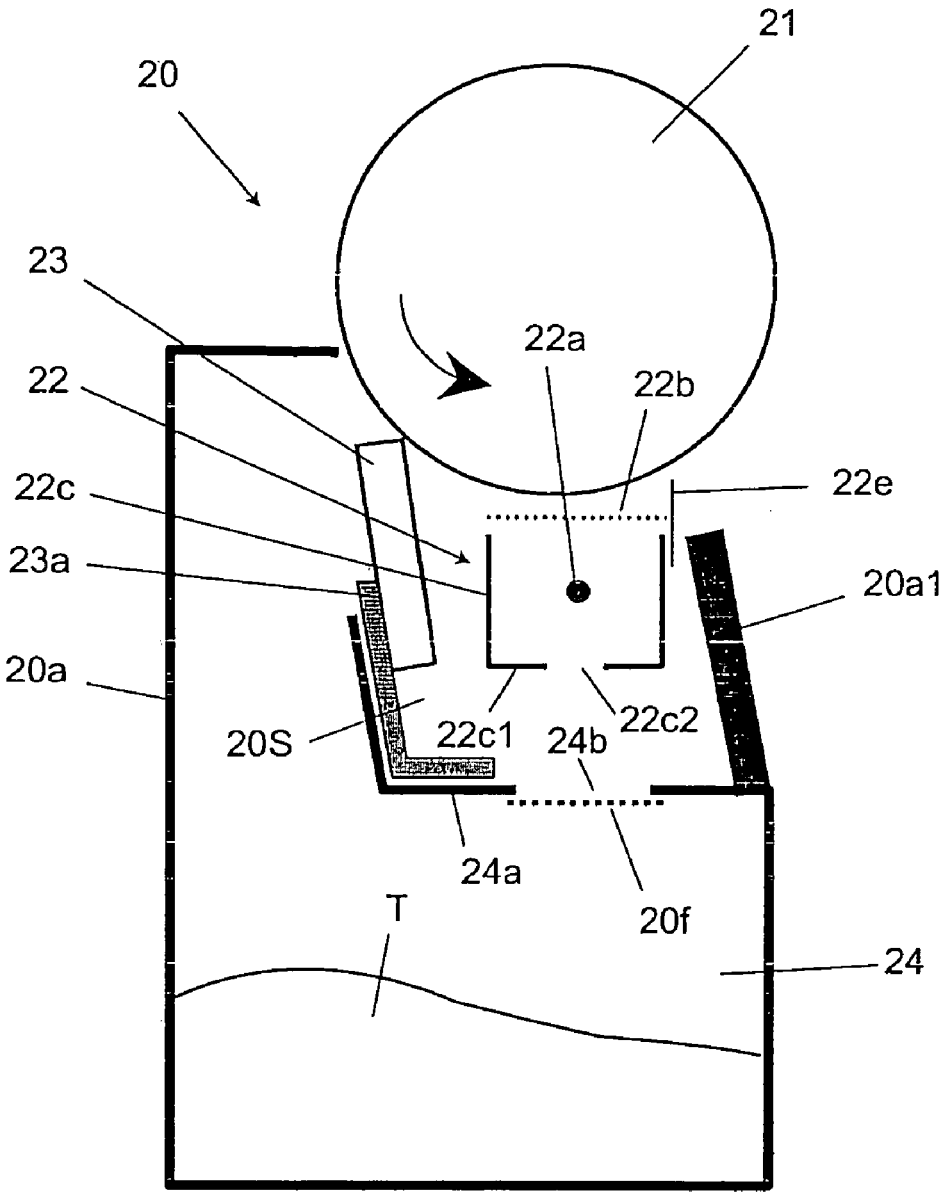
FIGS. 2 and 3 are section views of an image carrier unit in the image forming apparatus of FIG. 1.
Figure 3:
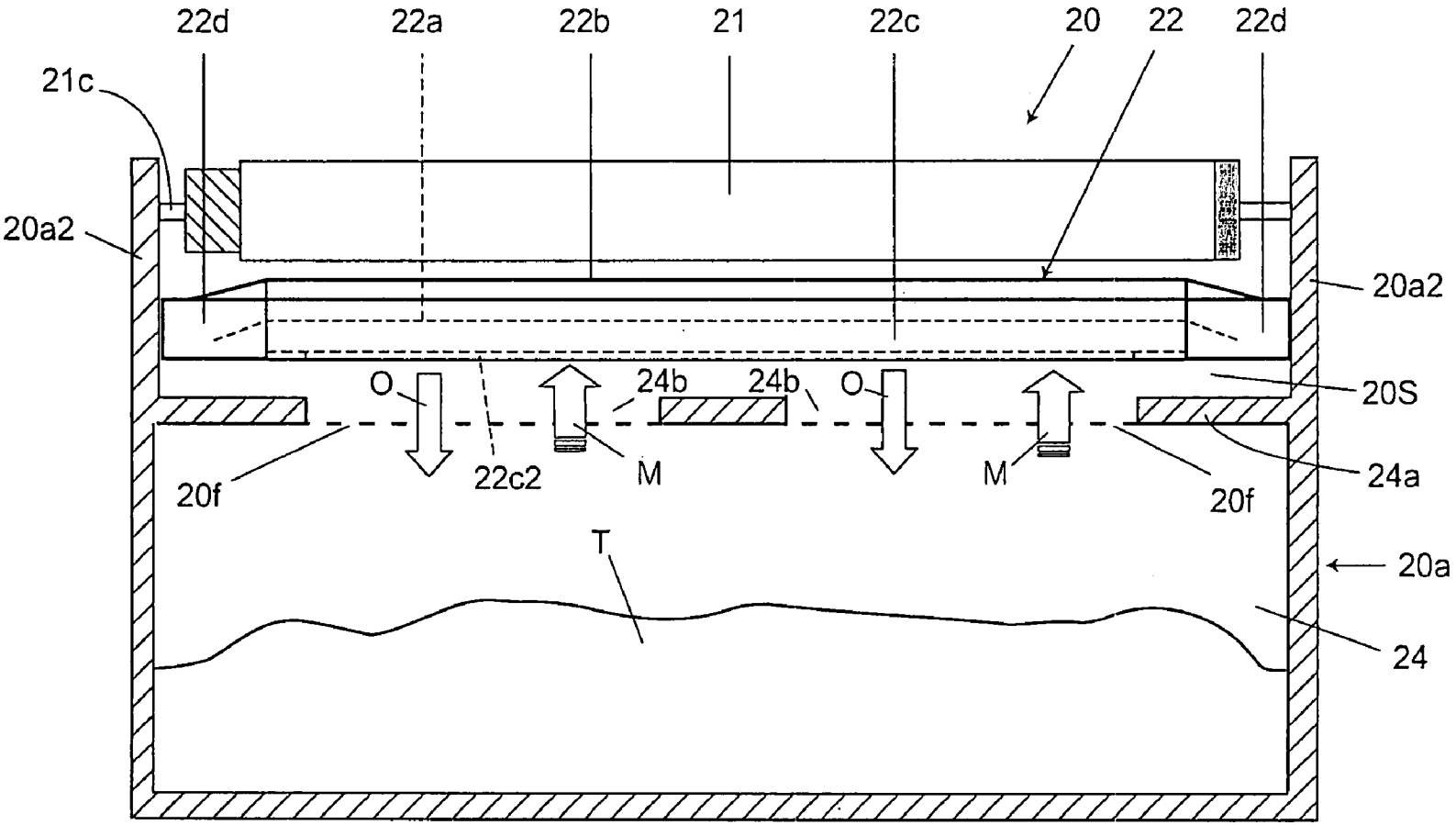

As shown in FIGS. 2 and 3, the corona charger 22 is a scorotron charger comprising: a wire-shaped discharge electrode 22*a* for charging the photosensitive body 21; a back plate 22*c* having a U-shaped cross section surrounding the discharge electrode 22*a* in order to carry out a stable discharge through the discharge electrode 22*a;* and a grid 22*b* for controlling a charging potential on the photosensitive body 21.

The photosensitive body 21 is supported rotatably on an axis 21*c* thereof with respect to a casing 20*a* of the image carrier unit 20 and is rotated by a driving mechanism which is not shown. The casing 20*a* is provided with the waste toner storage 24.

The corona charger 22 is attached to the casing 20*a*. A pair of left and right support members 22*d* support the discharge electrode 22*a* and the grid 22*b* and are attached to both ends of the back plate 22*c*.

A bottom portion 22*c*1 of the back plate 22*c* of the corona charger 22 is provided with an opening 22*c*2 extended in a longitudinal direction thereof.

A region in which the corona charger 22 is disposed is constituted as a charger housing space 20S to be an almost closed space. More specifically, the charger housing space 20S is constituted to be almost closed by: a top plate 24*a* of the waste toner storage 24; a blade support member 23*a* fixed to the top plate 24*a* and extended in a longitudinal direction of the photosensitive body 21 (an orthogonal direction to the sheet of FIG. 2) for supporting the cleaning blade 23; a side wall 20*a*1 extended in the longitudinal direction of the casing 20*a;* front and rear walls 20*a*2 and 20*a*2 of the casing 20*a* (see FIG. 3); the lower surface of the photosensitive body 21; and a sheet member 22*e* extended in a longitudinal direction of the photosensitive body 21 and provided on the side face of the back plate 22*c* in the vicinity of the upper edge of the side wall 20*a*1 and the surface of the photosensitive body 21.

The top plate 24*a* of the waste toner storage 24 is provided with openings 24*b* elongated in a longitudinal direction thereof. A vent filter 20*f* is provided on the top plate 24*a* so as to close the opening 24*b*.

The vent filter 20*f* causes ozone to pass therethrough and does not cause toner to pass therethrough (accordingly, causes a vapor or gas to pass therethrough), and the charger housing space 20S and the waste toner storage 24 communicate with each other through the filter 20*f*.

As is apparent from FIGS. 2 and 3, the photosensitive body 21, the corona charger 22 and the waste toner storage 24 are provided in this order from a top in the apparatus. Furthermore, the photosensitive body 21, the corona charger 22 and the waste toner storage 24 are constituted as one replaceable cartridge (the image carrier unit 20) including them.

With the above configuration, even if the ozone remains in the vicinity of the corona charger 22 after the image forming operation, the ozone moves downward by a self-weight thereof as shown in arrows O in FIG. 3. Specifically, the ozone in the corona charger 22 passes through the opening 22*c*2 of the back plate 22*c,* and moves downward to the waste toner storage 24 through the vent filter 20*f*. Since the toner has ozone adsorbing property, the ozone moving to the waste toner storage 24 is quickly adsorbed by the waste toner T.

Accordingly, it is possible to quickly remove the ozone present in the vicinity of the corona charger 22 after the end of the image formation without providing the air flow generator.

Since the vent filter 20*f* does not cause the toner to pass therethrough, the waste toner T in the waste toner storage 24 can be prevented from passing through the filter 20*f* toward the corona charger 22 and the photosensitive body 21. Accordingly, the corona charger 22 and the photosensitive body 21 can be prevented from being contaminated by the waste toner T.

A corona discharge is continuously carried out by the following processes: an electron accelerated in a high electric field collides with a neutral molecule and becomes an electron and a positive ion; a positive ion is accelerated in a high electric field to collide with a neutral molecule and becomes a positive ion and an electron; and a positive ion collides with a discharge electrode such as a wire to kick out electrons and returns to the neutral molecule. By the combination of the above processes, the corona discharge is continuously carried out. At this time, $H_2O$ is the source of the positive ion. Therefore, some humidity (water content) contributes to the stability of the discharge.

On the other hand, the toner has such a property as to adsorb the water content when a humidity therearound is high and to discharge the adsorbed water content when the humidity is low.

According to the above configuration, when a humidity around the corona charger 22 is relatively high, the water content passes through the vent filter 20*f* and is adsorbed into the waste toner T in the waste toner storage 24. To the contrary, when the humidity around the corona charger 22 is relatively low, the water content (the moisture) adsorbed into the waste toner T in the waste toner storage 24 is released and is supplied around the corona charger 22 through the vent filter 20*f* as shown in arrows M in FIG. 3.

Therefore, even in the case where continuous printing is carried out at low temperature and low humidity in a state that the discharge electrode 22*a* of the corona charger 22 is old, the discharge is stabilized by the water content supplied from the waste toner storage 24 so that an image defect or a change in a density is caused with difficulty.

As described above, according to the image forming apparatus, it is possible to quickly remove the ozone present in the vicinity of the corona charger after the image formation without providing any air flow generator. As a result, it is possible to prevent a noise from being made by the air flow generator after the end of the printing and to contribute to energy saving. Moreover, since the charger 22 is positioned below the photosensitive body 21, a chance for the ozone to come in contact with the photosensitive body 21 can be eliminated, thereby prolonging the lifetime of the photosensitive body 21.

Furthermore, since the photosensitive body 21, the corona charger 22 and the waste toner storage 24 are integrated as one replaceable cartridge. By causing the replacement timings of the photosensitive body 21, the corona charger 22 and the waste toner storage 24 to be coincident with each other. Therefore, it is possible to prevent a situation that the photosensitive body 21 and the charger 22 fall on the end of the lifetime when the waste toner is not present in the waste toner storage 24. In other words, even if the continuous printing is carried out at low temperature and low humidity in a state that the discharge electrode 22*a* of the corona charger 22 is old, the discharge is stabilized by the discharge of the water content from the waste toner T stored sufficiently in the waste toner storage 24.

Figure 4:
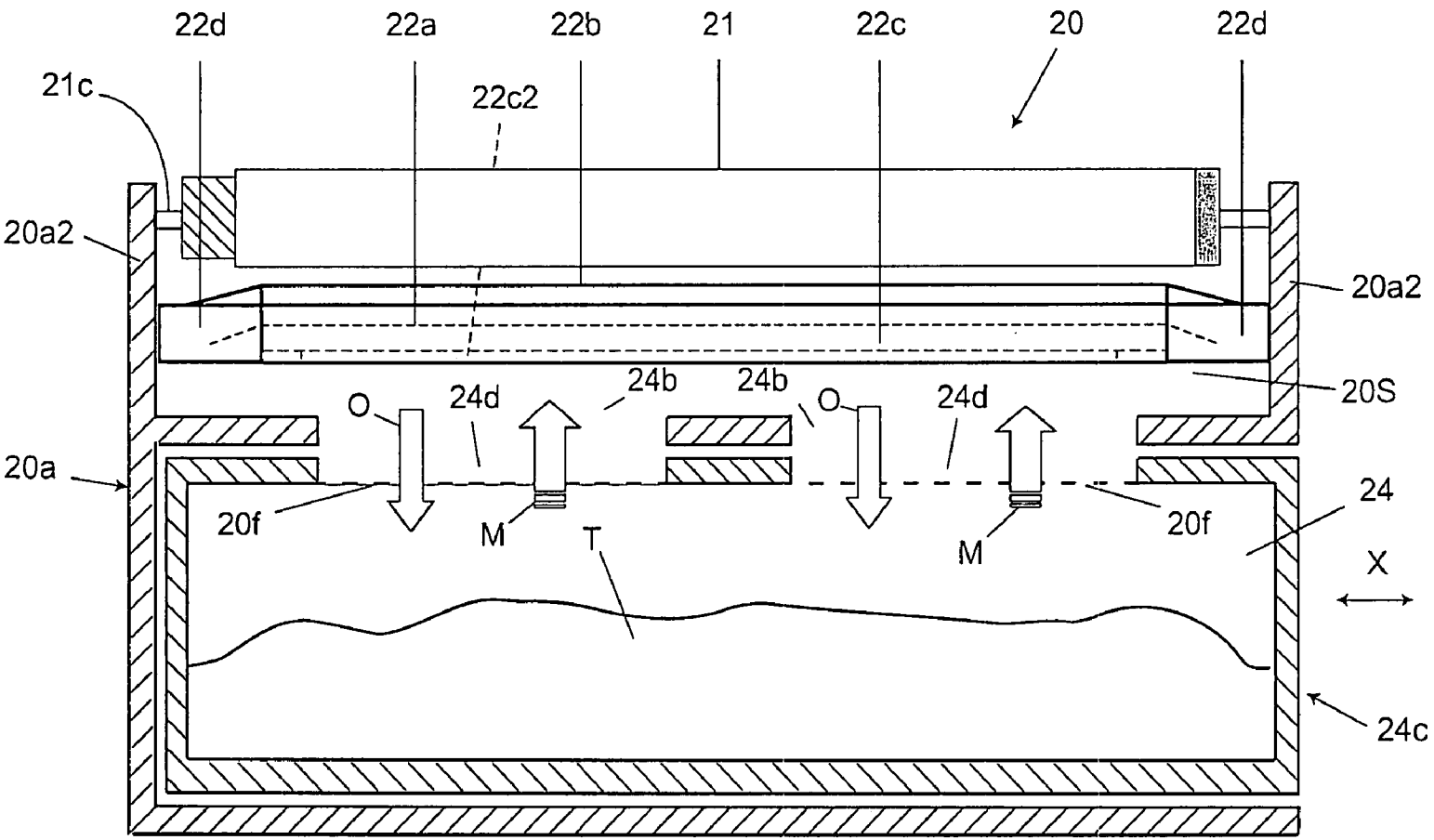
FIG. 4 is a section view of an image carrier unit according to a second embodiment of the invention.

Next, a second embodiment of the invention will be described with reference to FIG. 4. Components similar to those described in the first embodiment will be designated by the same reference numerals and repetitive explanations for those will be omitted.

This embodiment is different from the first embodiment in that a waste toner storage 24 is constituted to be solely replaceable and a vent filter 20*f* is provided in the water toner storage 24.

The waste toner storage 24 is constituted by an independent casing 24*c* and adapted to be moved in the direction of arrows X relative to a casing 20*a* of the image carrier unit 20.

Openings 24*d* are provided in a portion of the casing 24*c* which is opposed to an opening 24*b*, and the vent filter 20*f* is provided to close the opening 24*d* on the internal face side of the casing 24*c*.

In the case where the waste toner storage 24 is constituted to be solely replaceable, thus, the vent filter 20*f* is provided in the waste toner storage 24. Consequently, the vent filter 20*f* can be periodically replaced in accordance with the replacement of the waste toner storage 24, so that an almost constant vent efficiency can be maintained.

The above configuration is advantageous in a such a structure that excellent durability is given to a photosensitive body 21 and a corona charger 22 and the large volume of the waste toner storage 24 cannot be secured. In other words, with such a structure, it is possible to reduce the size of the waste toner storage 24 (therefore, to reduce the size of the whole image forming apparatus).

Figure 5:
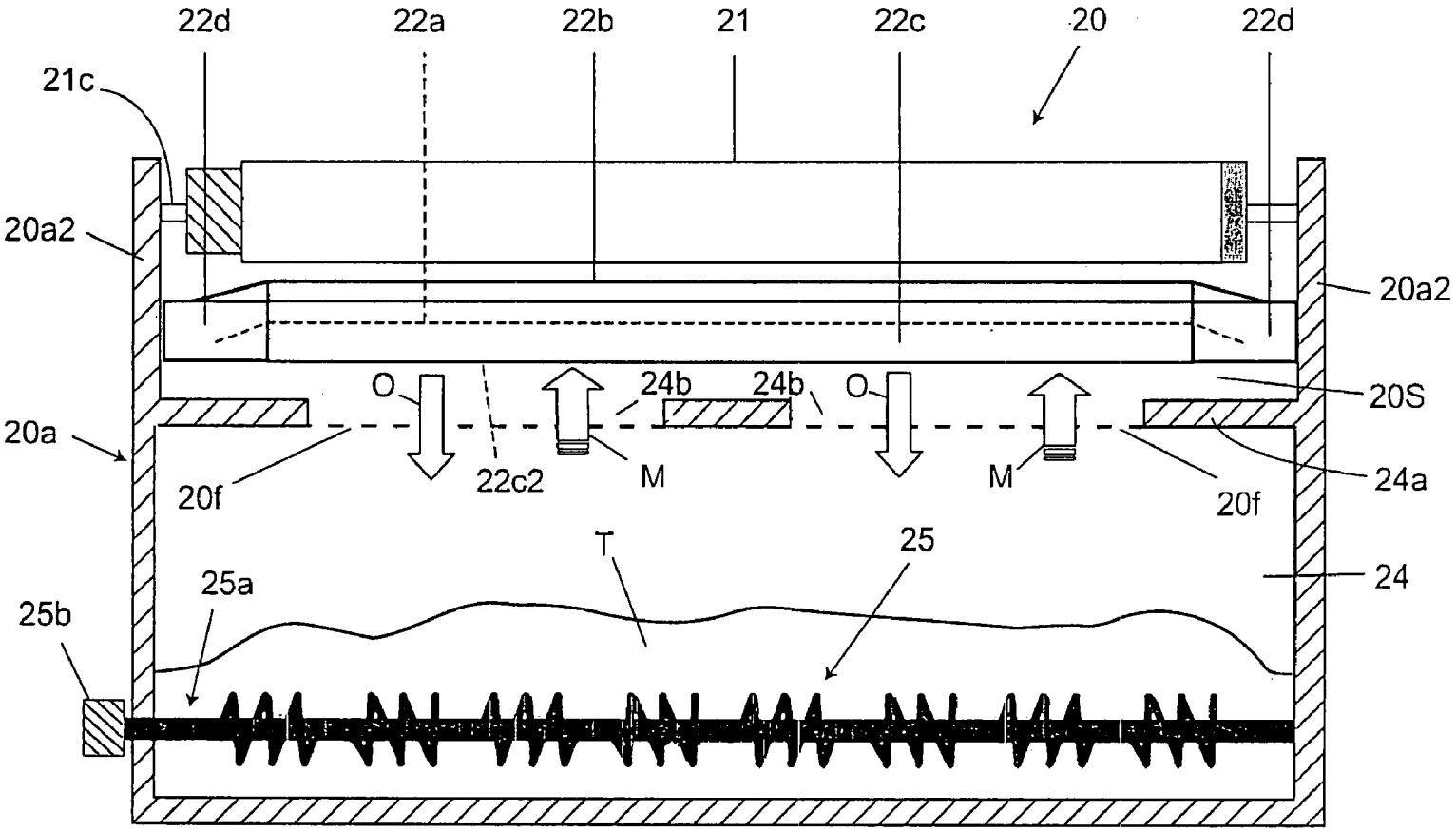
FIG. 5 is a section view of an image carrier unit according to a third embodiment of the invention.

Next, a third embodiment of the invention will be described with reference to FIG. 5. Components similar to those described in the first embodiment will be designated by the same reference numerals and repetitive explanations for those will be omitted.

This embodiment is different from the first embodiment in that an agitator 25 for agitating waste toner T is provided in a waste toner storage 24. The agitator 25 is provided with a delivery member for delivering the waste toner.

The agitator 25 has a shaft 25*a* rotatably supported by a casing 20*a* and a gear 25*b* provided on one of the ends of the shaft 25*a* is engaged with a gear (not shown) provided on the body side of the apparatus to rotate the shaft 25*a*.

Thus, the waste toner storage 24 is provided with the agitator 25 for agitating the waste toner T: Consequently, it is possible to renew the surface of the waste toner T in the storage 24. Thus, it is possible to obtain ozone adsorbing effect and a water content adsorbing and releasing effect efficiently and continuously.

Figure 6:
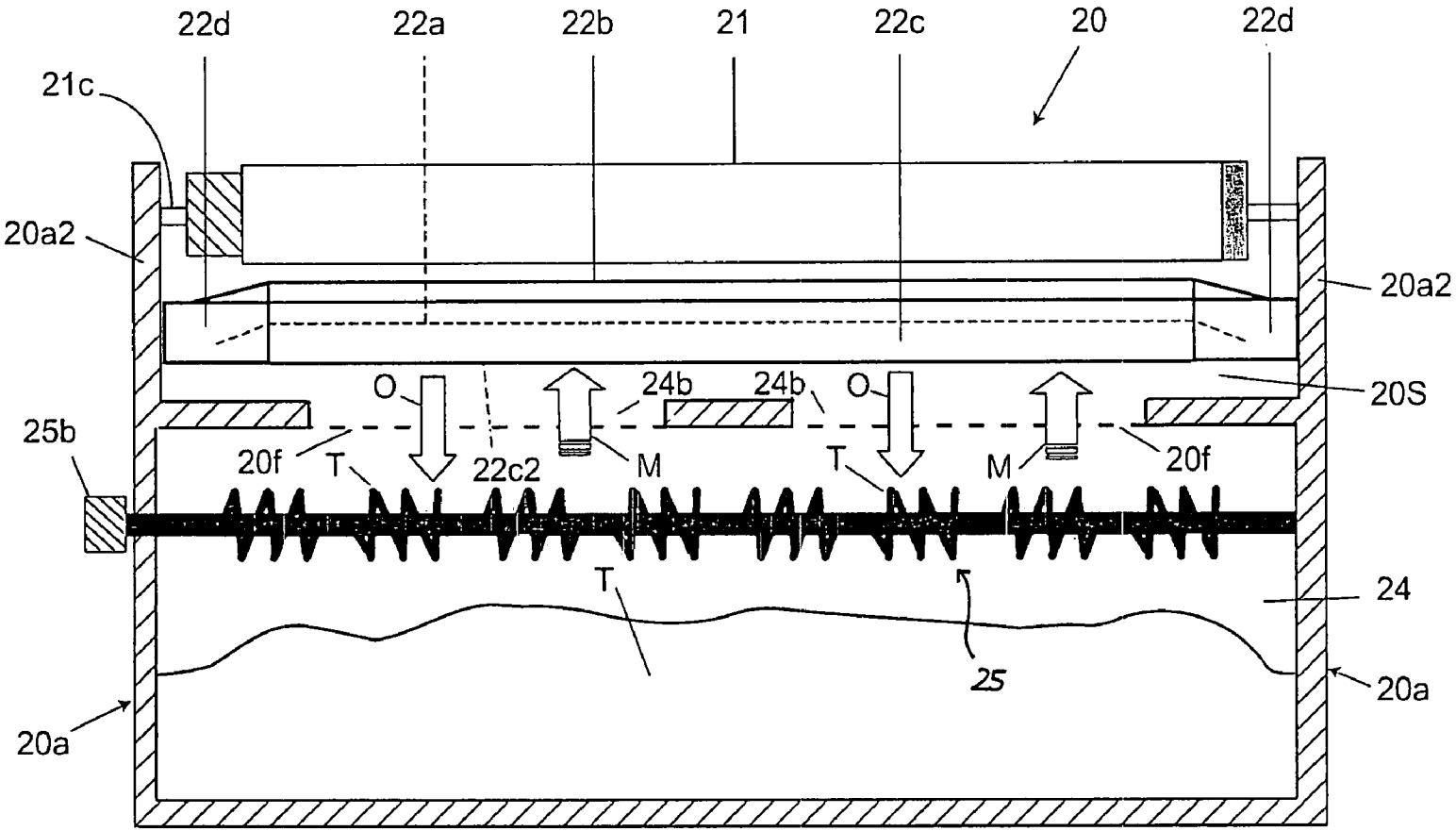
FIG. 6 is a section view of an image carrier unit according to a fourth embodiment of the invention.

Next, a fourth embodiment of the invention will be described with reference to FIG. 6. Components similar to those described in the first embodiment will be designated by the same reference numerals and repetitive explanations for those will be omitted.

This embodiment is different from the third embodiment in that a agitator 25 is provided in the vicinity of a vent filter 20*f*. Consequently, ozone passing through the vent filter 20*f* can be adsorbed more quickly by waste toner T stuck to the agitator 25.

Figure 7:
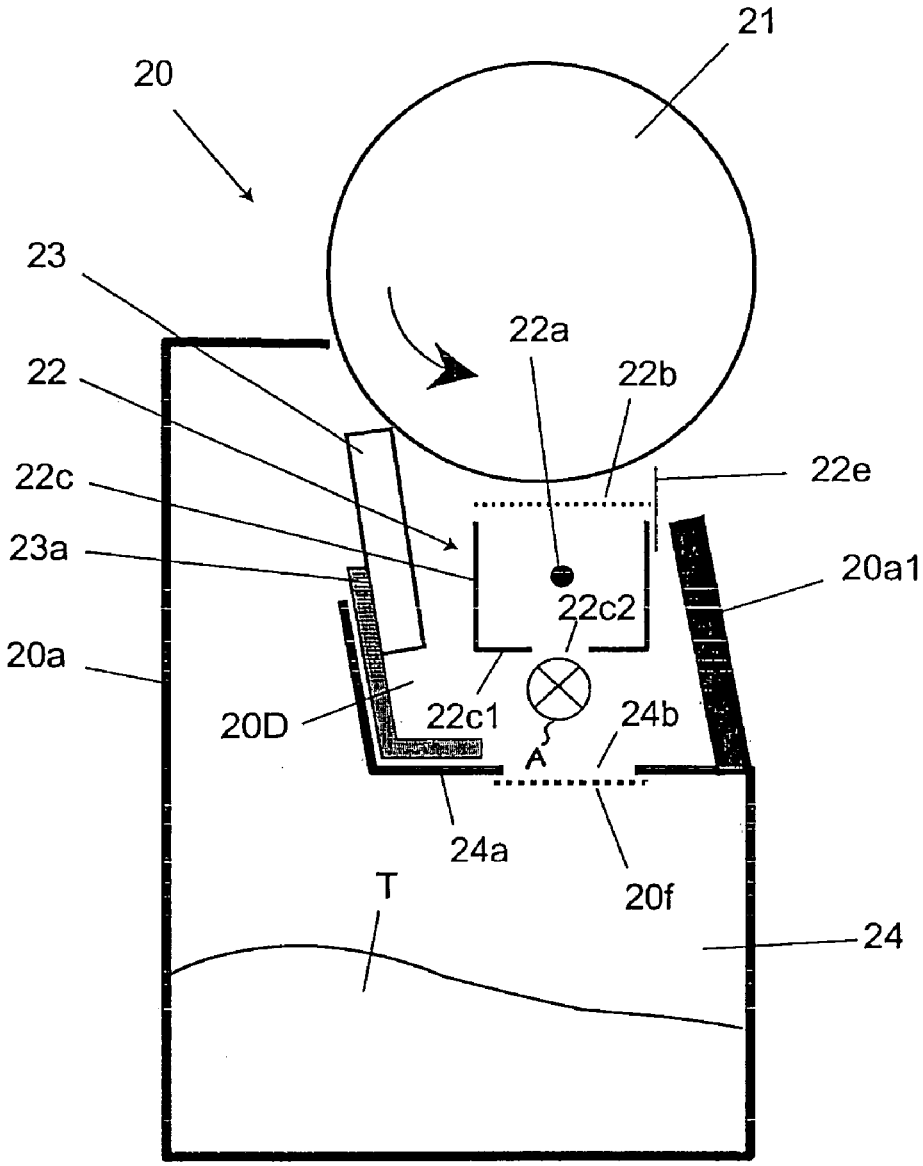
FIGS. 7 and 8 are section views of an image carrier unit according to a fifth embodiment of the invention.

Next, a fifth embodiment of the invention will be described with reference to FIGS. 7 and 8. Components similar to those described in the first embodiment will be designated by the same reference numerals and repetitive explanations for those will be omitted.

This embodiment is different from the first embodiment in that the bottom plate 22*c*1 of the back plate 22*c* of the corona charger 22 is provided with an opening 22*c*2 extended in a longitudinal direction thereof.

The corona charger 22 is provided in the duct 20D which is constituted by: a top plate 24*a* of the waste toner storage 24; a blade support member 23*a* fixed to the top plate 24*a* and extended in a longitudinal direction of the photosensitive body 21 (an orthogonal direction to the sheet of FIG. 7) for supporting the cleaning blade 23; a side wall 20*a*1 extended in the longitudinal direction of the casing 20*a*; the lower surface of the photosensitive body 21, and a sheet member 22*e* extended in a longitudinal direction of the photosensitive body 21 and provided on the side face of the back plate 22*c* in the vicinity of the upper edge of the side wall 20*a*1 and the surface of the photosensitive body 21.

Figure 8:
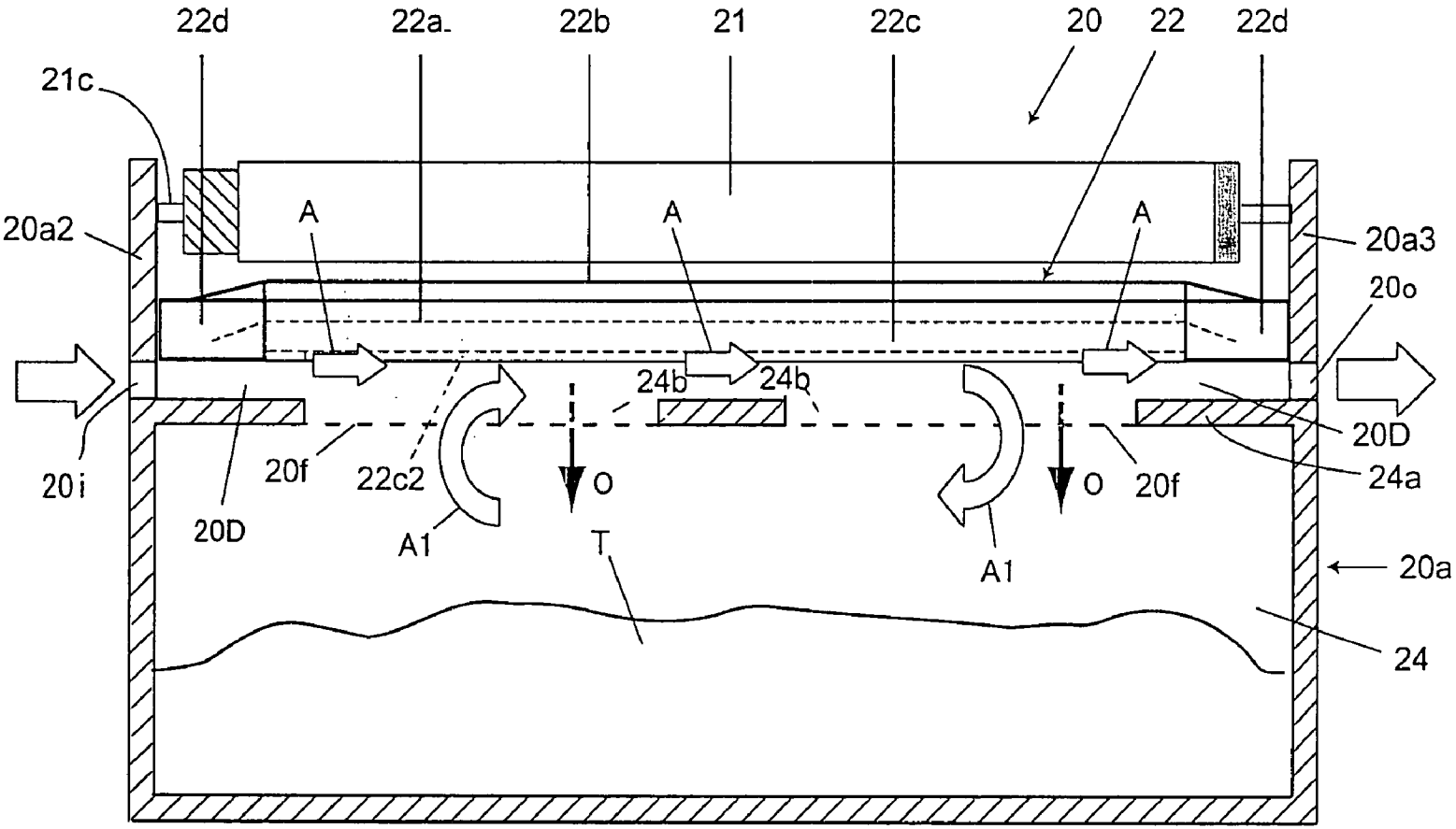

As shown in FIG. 8, an inlet 20*i* of the duct 20D is provided on a front wall 20*a*2 of the casing 20*a* and an outlet 20*o* of the duct 20D is provided on a rear wall 20*a*3.

An air flow generator for generating an air flow A within the duct 20D is constituted by a ventilating fan or the like (not shown) which is provided on the inlet 20*i* (or an upstream side thereof) or a suction fan or the like (not shown) which is provided on the outlet 20*o* (or a downstream side thereof).

With this configuration, as shown in FIG. 8, ozone generated in the vicinity of the corona charger 22 during the image formation is quickly discharged by the air flow A flowing in the duct 20D. In addition, a part of the air flow A flows into the corona charger 22 from the opening 22*c*2 of the back plate 22*c* so that the ozone present in the corona charger 22 is discharged quickly. Further, a part of the air flow enters the waste toner storage 24 from the duct 20D, and returns from the waste toner storage 24 to the duct 20D as shown in arrows A1 in FIG. 8.

Even in the case where the air flow generator is deactivated after the image formation, the ozone remaining in the vicinity of the corona charger 22 moves to the waste toner storage 24 through the vent filter 20*f* as shown in arrows O in FIG. 8.

Moreover, since the waste toner storage 24 is provided below the duct 20D through the vent filter 20*f*, the ozone remaining in the vicinity of the corona charger 22 moves downward by self-weight thereof through the opening 22*c*2, the duct 20D and the vent filter 20*f* as shown in the arrows O in FIG. 8, even in the case where the air flow generator is deactivated after the image formation.

Moreover, the photosensitive body 21, the corona charger 22 and the waste toner storage 24 are provided in this order from a top in the apparatus. Therefore, an opportunity for the ozone to come in contact with the photosensitive body 21 can be reduced and the lifetime of the photosensitive body 21 can be enhanced.

Furthermore, the photosensitive body 21, the corona charger 22 and the waste toner storage 24 are constituted as one exchangeable cartridge (the image carrier unit 20) including at least them. By causing the exchange timings of the photosensitive body 21, the corona charger 20 and the waste toner storage 24 to be coincident with each other, therefore, it is possible to prevent a situation in which the photosensitive body 21 and the charger 22 fall on the end of the lifetime when the waste toner T is not present in the waste toner storage 24. Thus, it is possible to obtain necessary advantages (the advantages described above) if necessary.

Figure 9:
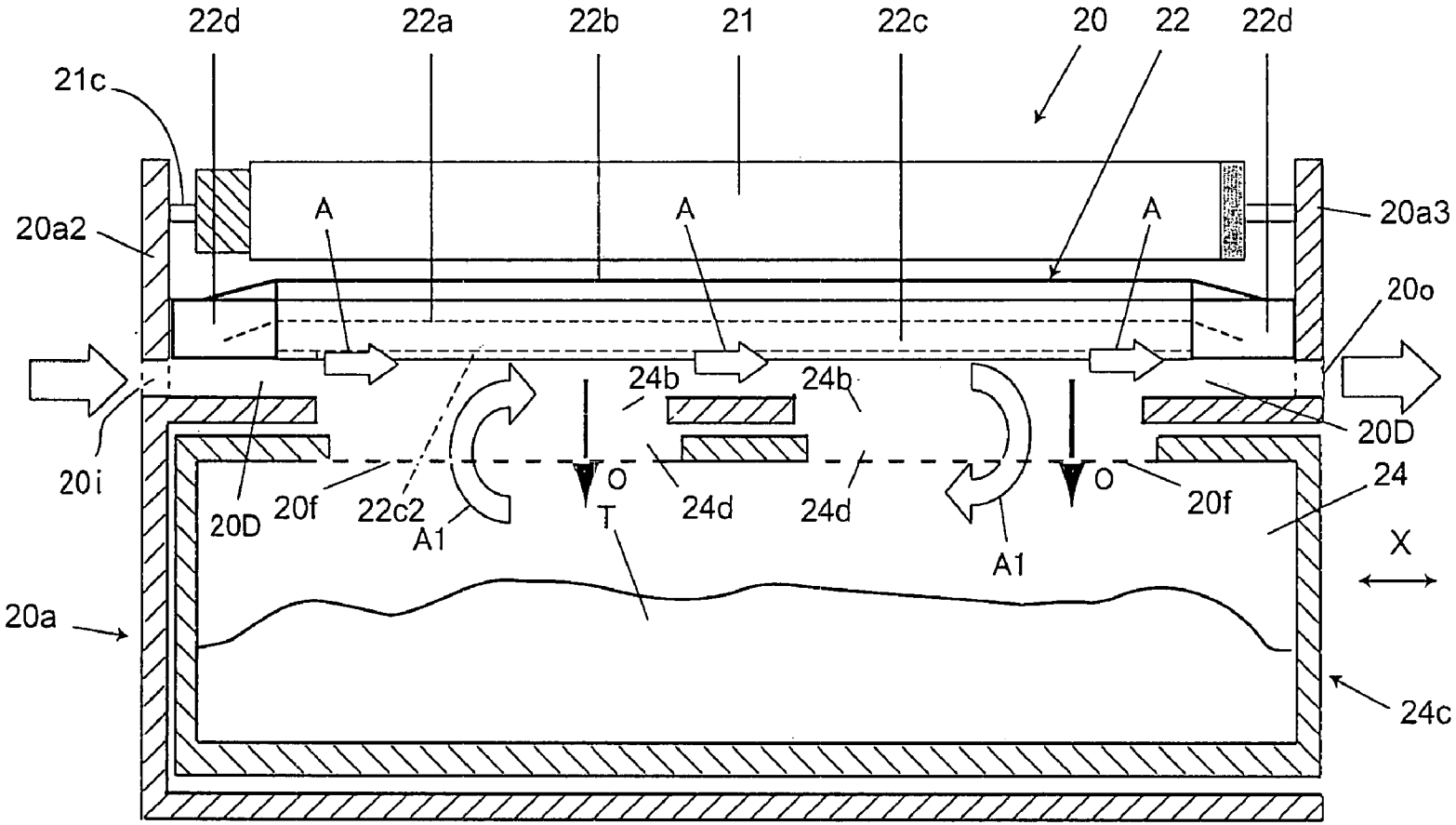
FIG. 9 is a section view of an image carrier unit according to a sixth embodiment of the invention.

Next, a sixth embodiment of the invention will be described with reference to FIG. 9. Components similar to those described in the fifth embodiment will be designated by the same reference numerals and repetitive explanations for those will be omitted.

This embodiment is different from the fifth embodiment in that a waste toner storage 24 is constituted to be solely replaceable and a vent filter 20*f* is provided in the water toner storage 24.

The waste toner storage 24 is constituted by an independent casing 24*c* and adapted to be moved in the direction of arrows X relative to a casing 20*a* of the image carrier unit 20.

Openings 24*d* are provided in a portion of the casing 24*c* which is opposed to an opening 24*b*, and the vent filter 20*f* is provided to close the opening 24*d* on the internal face side of the casing 24*c*.

In the case where the waste toner storage 24 is constituted to be solely replaceable, thus, the vent filter 20*f* is provided in the waste toner storage 24. Consequently, the vent filter 20*f* can be periodically replaced in accordance with the replacement of the waste toner storage 24, so that an almost constant vent efficiency can be maintained.

The above configuration is advantageous in a such a structure that excellent durability is given to a photosensitive body 21 and a corona charger 22 and the large volume of the waste toner storage 24 cannot be secured. In other words, with such a structure, it is possible to reduce the size of the waste toner storage 24 (therefore, to reduce the size of the whole image forming apparatus).

Figure 10:
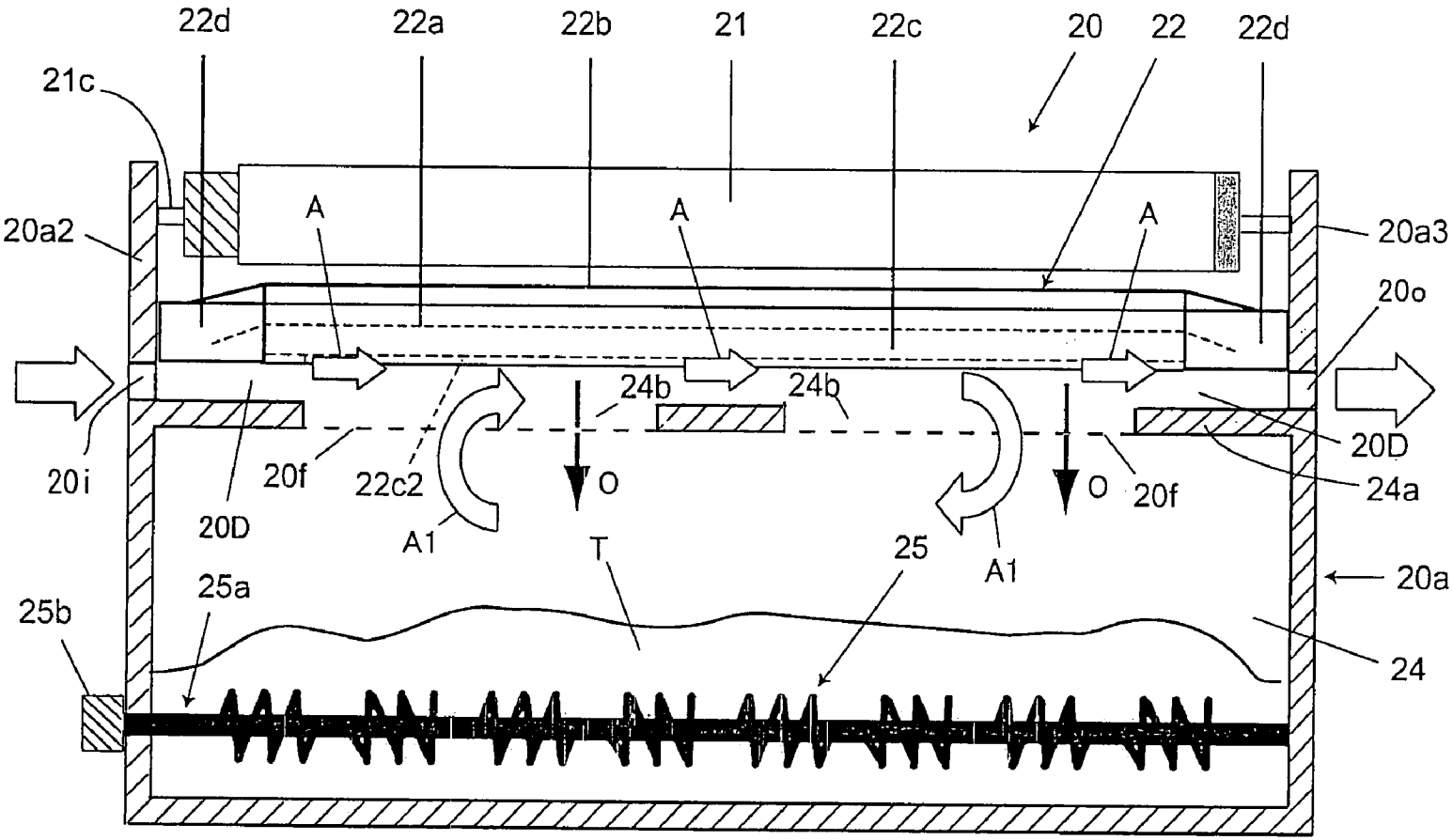
FIG. 10 is a section view of an image carrier unit according to a seventh embodiment of the invention.

Next, a seventh embodiment of the invention will be described with reference to FIG. 10. Components similar to those described in the fifth embodiment will be designated by the same reference numerals and repetitive explanations for those will be omitted.

This embodiment is different from the fifth embodiment in that an agitator 25 for agitating waste toner T is provided in a waste toner storage 24. The agitator 25 is provided with a delivery member for delivering the waste toner.

The agitator 25 has a shaft 25*a* rotatably supported by a casing 20*a* and a gear 25*b* provided on one of the ends of the shaft 25*a* is engaged with a gear (not shown) provided on the body side of the apparatus to rotate the shaft 25*a*.

Thus, the waste toner storage 24 is provided with the agitator 25 for agitating the waste toner T. Consequently, it is possible to renew the surface of the waste toner T in the storage 24. Thus, it is possible to obtain ozone adsorbing effect and a water content adsorbing and releasing effect efficiently and continuously.

Figure 11:
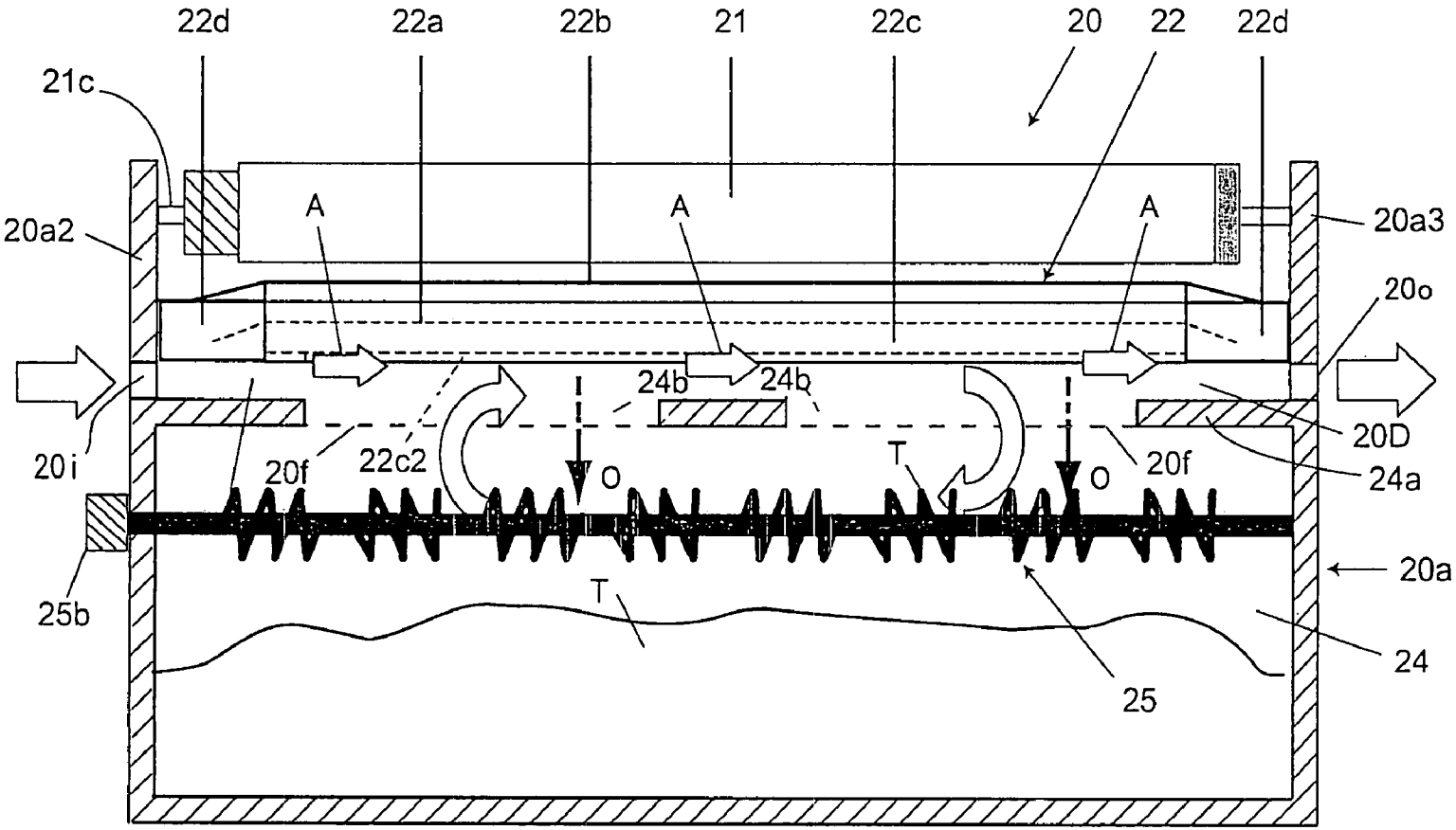
FIG. 11 is a section view of an image carrier unit according to an eighth embodiment of the invention.

Next, an eighth embodiment of the invention will be described with reference to FIG. 11. Components similar to those described in the fifth embodiment will be designated by the same reference numerals and repetitive explanations for those will be omitted.

This embodiment is different from the seventh embodiment in that a agitator 25 is provided in the vicinity of a vent filter 20*f*. Consequently, ozone passing through the vent filter 20*f* can be adsorbed more quickly by waste toner T stuck to the agitator 25.

Next, a ninth embodiment of the invention will be described with reference to FIGS. 12A to 12E. Components similar to those described in the fifth embodiment will be designated by the same reference numerals and repetitive explanations for those will be omitted.

Figure 12A:
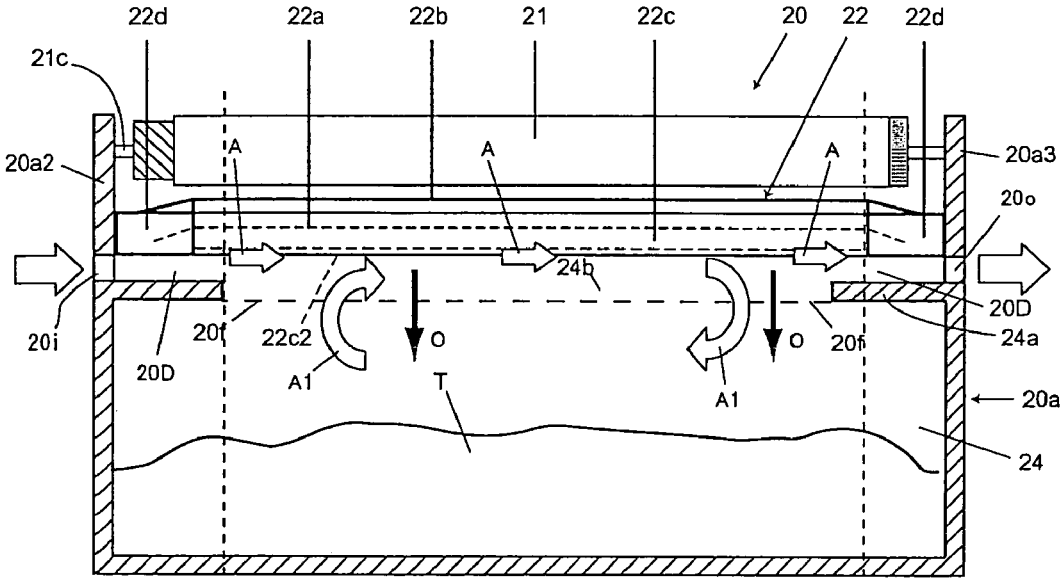
FIG. 12A is a section view of an image carrier unit according to a ninth embodiment of the invention.
Figure 12B:
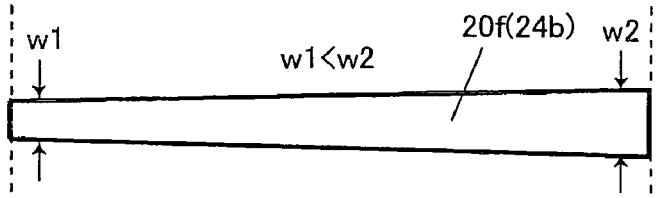
FIG. 12B is a plan view of a vent filter in the image carrier unit of FIG. 12A.

This embodiment is different from the fifth embodiment in that the width of the vent filter 20*f* is made wider in the downstream side of an air flow A than in the upstream side thereof (w2>w1 in FIG. 12B). In addition, the opening width of an opening 22*c*2 of a bottom plate 22*c*1 of a back plate 22*c* is also made wider in the downstream side of the air flow A than that in the upstream side thereof (t2>t1 in FIG. 12D).

Figure 12C:
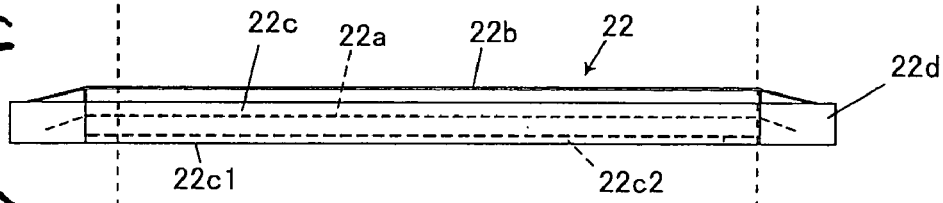
FIG. 12C is a side view of a corona charger in the image carrier unit of FIG. 12A.
Figure 12D:
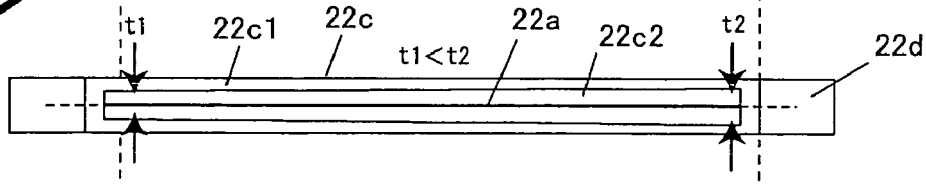
FIG. 12D is a bottom view of the corona charger of FIG. 12C.
Figure 12E:
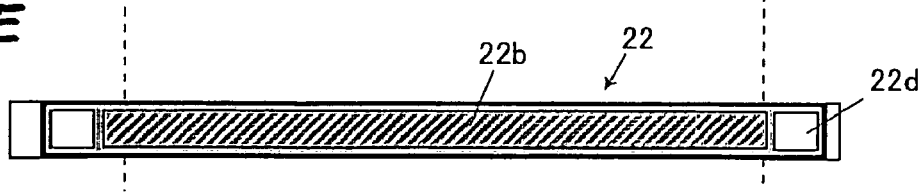
FIG. 12E is a top view of the corona charger of FIG. 12C.

As described the above, ozone is apt to stay on the downstream side of the air flow in the vicinity of the corona charger 22 (in the right side in FIGS. 12A, 12C and 12E). With the above configuration, however, the ozone which is apt to stay on the downstream side can be caused to quickly move to a waste toner storage 24 through the opening 22*c*2 and the vent filter 20*f*, and the ozone is thereby adsorbed into a waste toner T.

Next, a tenth embodiment of the invention will be described with reference to FIGS. 13 and 14. Components similar to those described in the fifth embodiment will be designated by the same reference numerals and repetitive explanations for those will be omitted.

Figure 13:
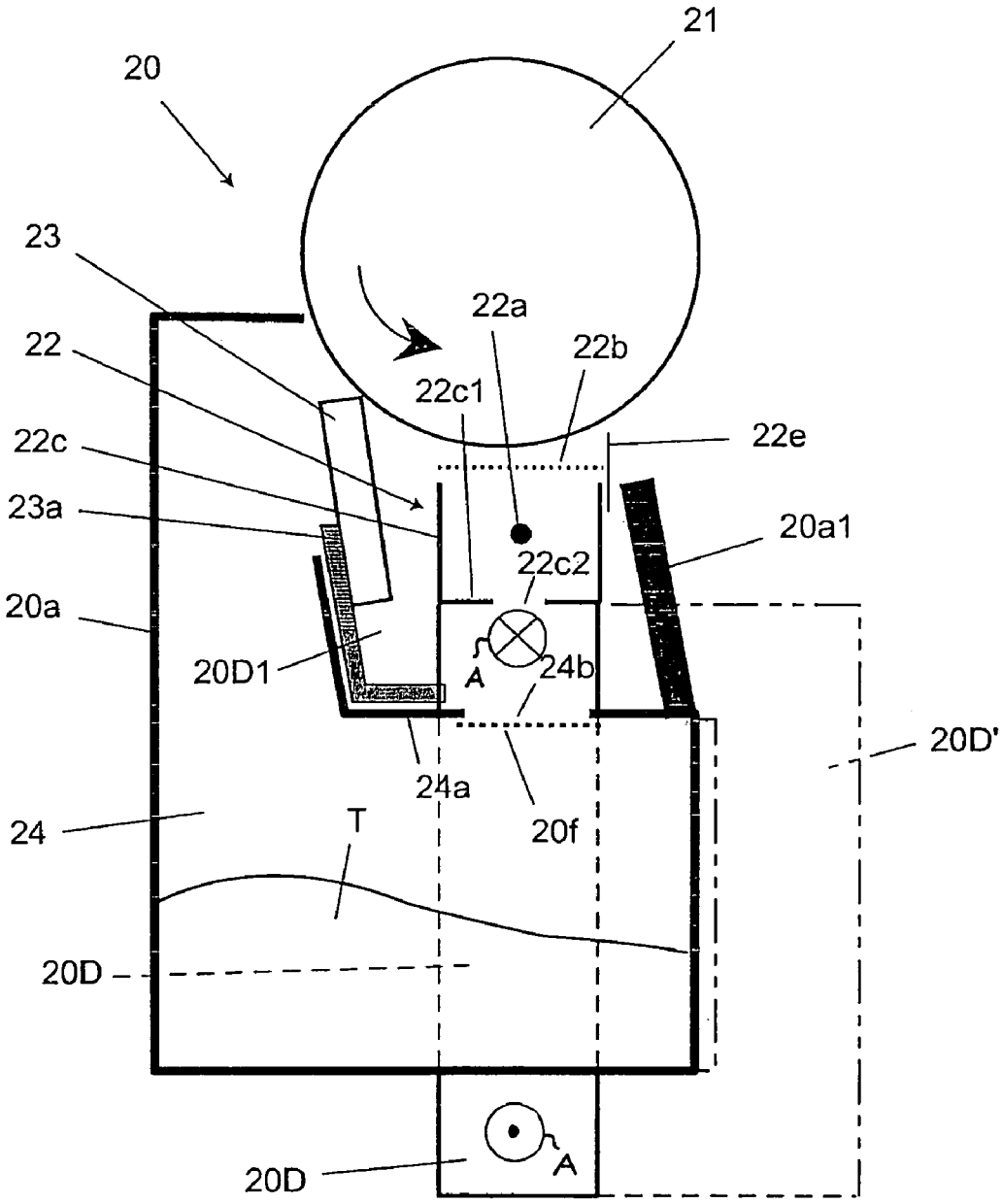
FIGS. 13 and 14 are section views of an image carrier unit according to a tenth embodiment of the invention.
Figure 14:
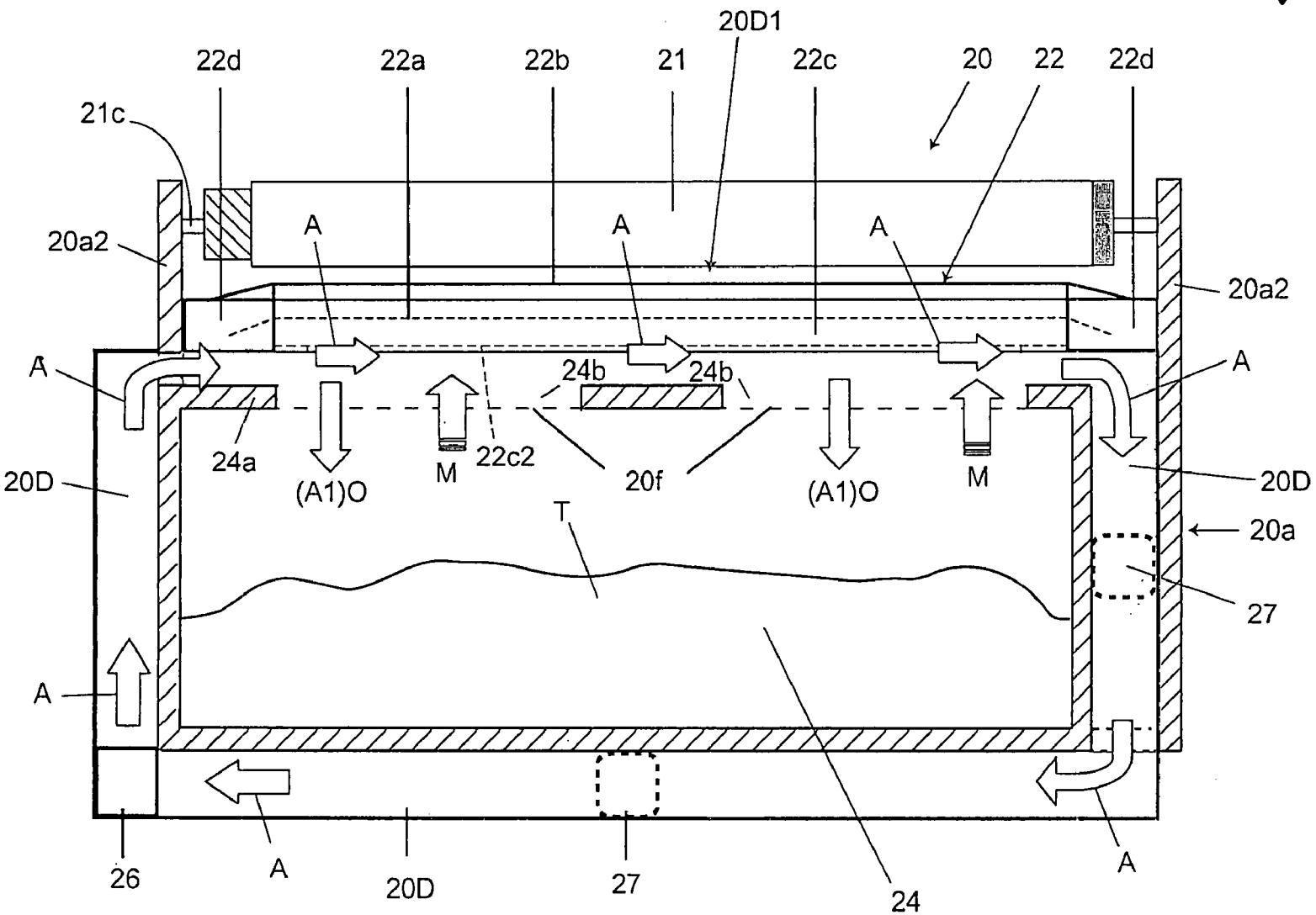

This embodiment is different from the fifth embodiment in that a closed-loop duct 20D is provided around a waste toner storage 24 as shown in FIG. 14. More specifically, an upper portion 20D1 of the duct 20D on which the corona charger 22 is provided is constituted by: a top plate 24*a* of the waste toner storage 24; a blade support member 23*a* fixed to the top plate 24*a* and extended in a longitudinal direction of a photosensitive body 21 (an orthogonal direction to the paper of FIG. 13) for supporting a cleaning blade 23; a side wall 20*a*1 extended in the longitudinal direction of the casing 20*a;* the lower surface of the photosensitive body 21; and a sheet member 22*e* extended in a longitudinal direction of the photosensitive body 21 and provided on the side face of the back plate 22*c* in the vicinity of the upper edge of the side wall 20*a*1 and the surface of the photosensitive body 21.

As shown in FIG. 14, an air flow generator 26 such as a fan for generating an air flow A within the duct 20D and ozone removers 27 such as filters are provided in the duct 20D, so that the duct 20D and the air flow generator 26 constitute a closed ventilation path.

The ozone remover 27 does not need to be provided or only one ozone remover 27 may be provided.

In this embodiment, the waste toner storage 24 is provided below the upper part 20D1 of the duct 20D including portions extending vertically. However, the waste toner storage 24 may be located below the lower part of the duct 20D. Alternatively, the duct 20D may be configured all portions thereof extend horizontally and the waste toner storage 24 is located below an arbitrary part of the duct 20D.

With the above configuration, since the corona charger 22 is disposed within the duct 20D which is configured to be a closed ventilation path, a foreign substance such as a volatile substance generated from the fuser unit 60 will not enter the duct 20D (i.e., the corona charger 22). Even if the foreign substance enters the duct 20D, an amount thereof is very small.

Consequently, it is possible to prevent the corona charger 22 from being contaminated by the foreign substance such as the volatile substance generated from the fuser unit 60. Thus, it is possible to obtain a uniform charging condition.

In addition, as is apparent from FIG. 1, the intermediate transfer unit 50 (the intermediate transfer belt 51) is provided between the fuser unit 60 and the image carrier unit 20 (i.e., the duct 20D and the corona charger 22) in such a state as to almost block both of them. Therefore, the volatile substance generated in the fuser unit 60 is almost blocked by the intermediate transfer unit 50 and hardly reaches the image carrier unit 20. Accordingly, the corona charger 22 is hardly contaminated by the volatile substance generated from the fuser unit 60. Thus, it is possible to obtain the uniform charging condition more reliably.

That is, ozone generated in the corona charger 22 is not only prevented from flowing to the outside, but also removed from the peripheral portion of the corona charger 22 and adsorbed into the waste toner T in the waste toner storage 24.

Furthermore, since the ozone remover 27 is provided in the closed ventilation path, the ozone in the ventilation path can be removed more positively.

Figure 15:
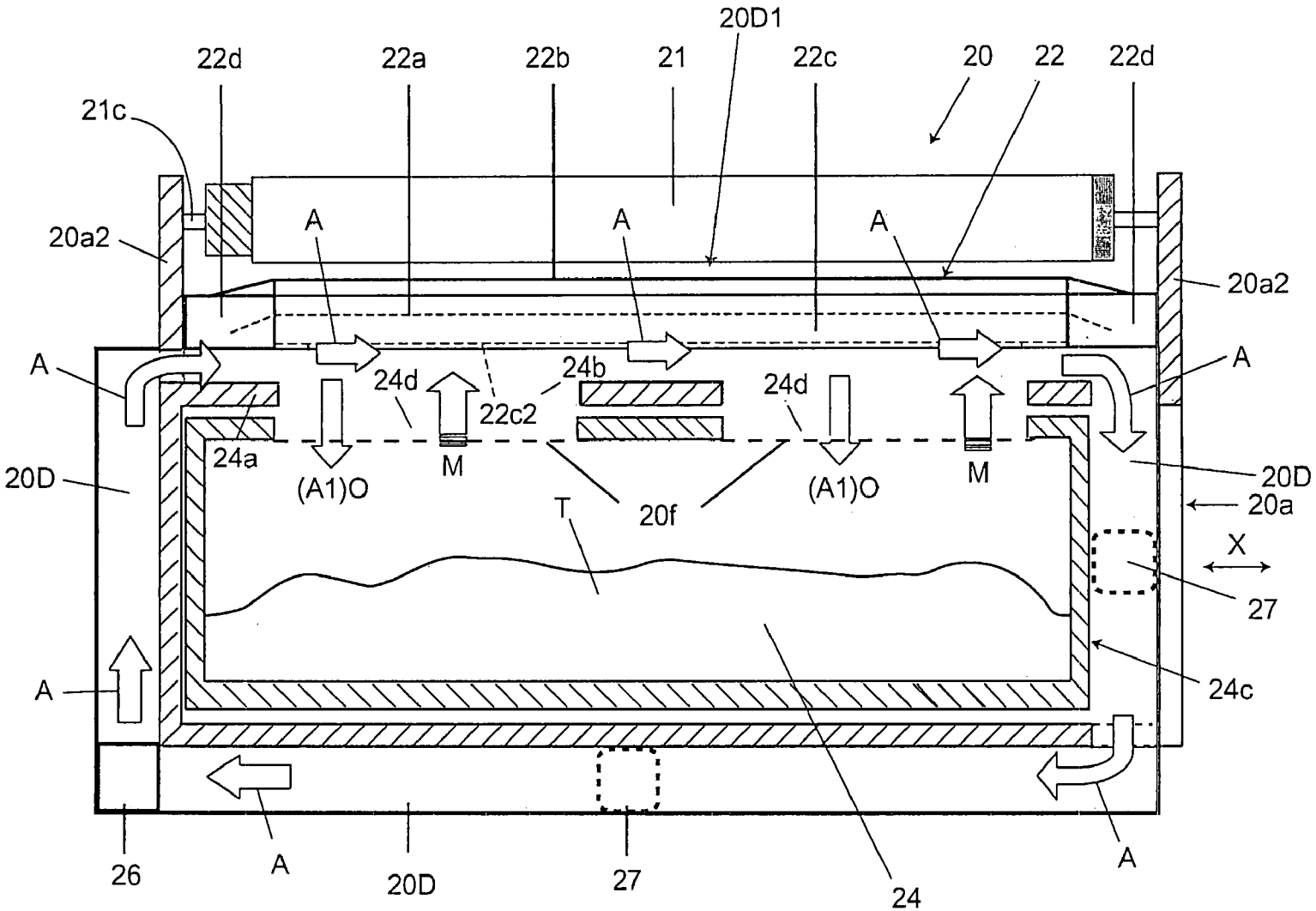
FIG. 15 is a section view of an image carrier unit according to an eleventh embodiment of the invention.

Next, an eleventh embodiment of the invention will be described with reference to FIG. 15. Components similar to those described in the tenth embodiment will be designated by the same reference numerals and repetitive explanations for those will be omitted.

This embodiment is different from the tenth embodiment in that a waste toner storage 24 is constituted to be solely replaceable and a vent filter 20*f* is provided in the water toner storage 24.

The waste toner storage 24 is constituted by an independent casing 24*c* and adapted to be moved in the direction of arrows X relative to a casing 20*a* of the image carrier unit 20.

Openings 24*d* are provided in a portion of the casing 24*c* which is opposed to an opening 24*b,* and the vent filter 20*f* is provided to close the opening 24*d* on the internal face side of the casing 24*c*.

In the case where the waste toner storage 24 is constituted to be solely replaceable, thus, the vent filter 20*f* is provided in the waste toner storage 24. Consequently, the vent filter 20*f* can be periodically replaced in accordance with the replacement of the waste toner storage 24, so that an almost constant vent efficiency can be maintained.

The above configuration is advantageous in a such a structure that excellent durability is given to a photosensitive body 21 and a corona charger 22 and the large volume of the waste toner storage 24 cannot be secured. In other words, with such a structure, it is possible to reduce the size of the waste toner storage 24 (therefore, to reduce the size of the whole image forming apparatus).

In this case, the duct 20D causes the waste toner storage 24 to make a detour so as not to interfere with the casing 24*c* during the replacement, as shown in dashed chain lines 20D' in FIG. 13.

Figure 16:
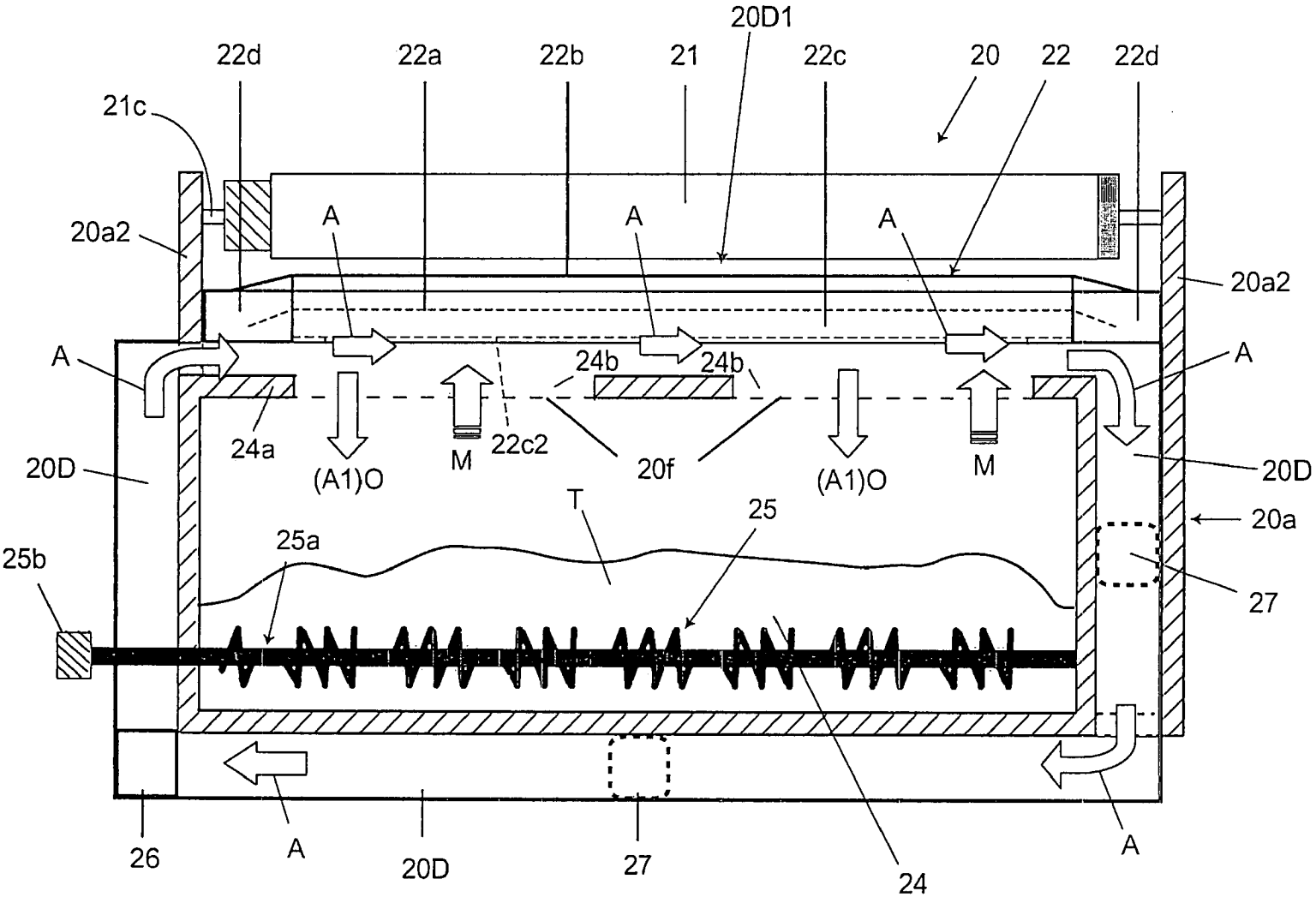
FIG. 16 is a section view of an image carrier unit according to a twelfth embodiment of the invention.

Next, a twelfth embodiment of the invention will be described with reference to FIG. 16. Components similar to those described in the tenth embodiment will be designated by the same reference numerals and repetitive explanations for those will be omitted.

This embodiment is different from the tenth embodiment in that an agitator 25 for agitating waste toner T is provided in a waste toner storage 24. The agitator 25 is provided with a delivery member for delivering the waste toner.

The agitator 25 has a shaft 25*a* rotatably supported by a casing 20*a* and a gear 25*b* provided on one of the ends of the shaft 25*a* is engaged with a gear (not shown) provided on the body side of the apparatus to rotate the shaft 25*a*.

Thus, the waste toner storage 24 is provided with the agitator 25 for agitating the waste toner T. Consequently, it is possible to renew the surface of the waste toner T in the storage 24. Thus, it is possible to obtain ozone adsorbing effect and a water content adsorbing and releasing effect efficiently and continuously.

In this case, the duct 20D causes the waste toner storage 24 to make a detour so as not to interfere with the shaft 25*a* and the gear 25*b* of the agitator 25 as shown in the dashed chain line 20D' in FIG. 13.

Figure 17:
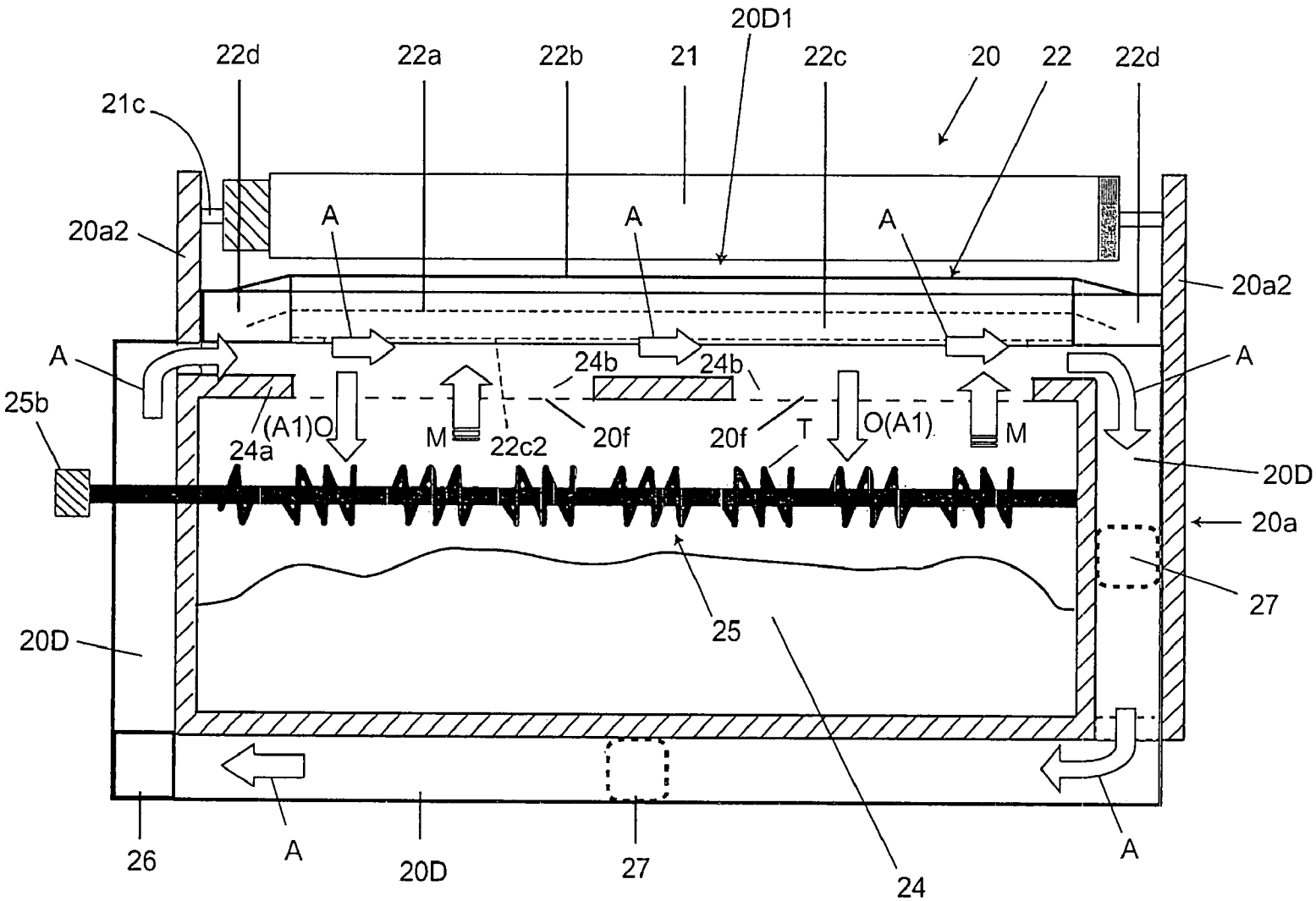
FIG. 17 is a section view of an image carrier unit according to a thirteenth embodiment of the invention.

Next, a thirteenth embodiment of the invention will be described with reference to FIG. 17. Components similar to those described in the tenth embodiment will be designated by the same reference numerals and repetitive explanations for those will be omitted.

This embodiment is different from the twelfth embodiment in that a agitator 25 is provided in the vicinity of a vent filter 20*f.* Consequently, ozone passing through the vent filter 20*f* can be adsorbed more quickly by waste toner T stuck to the agitator 25.

Next, a fourteenth embodiment of the invention will be described with reference to FIGS. 18A to 18E. Components similar to those described in the tenth embodiment will be designated by the same reference numerals and repetitive explanations for those will be omitted.

Figure 18A:
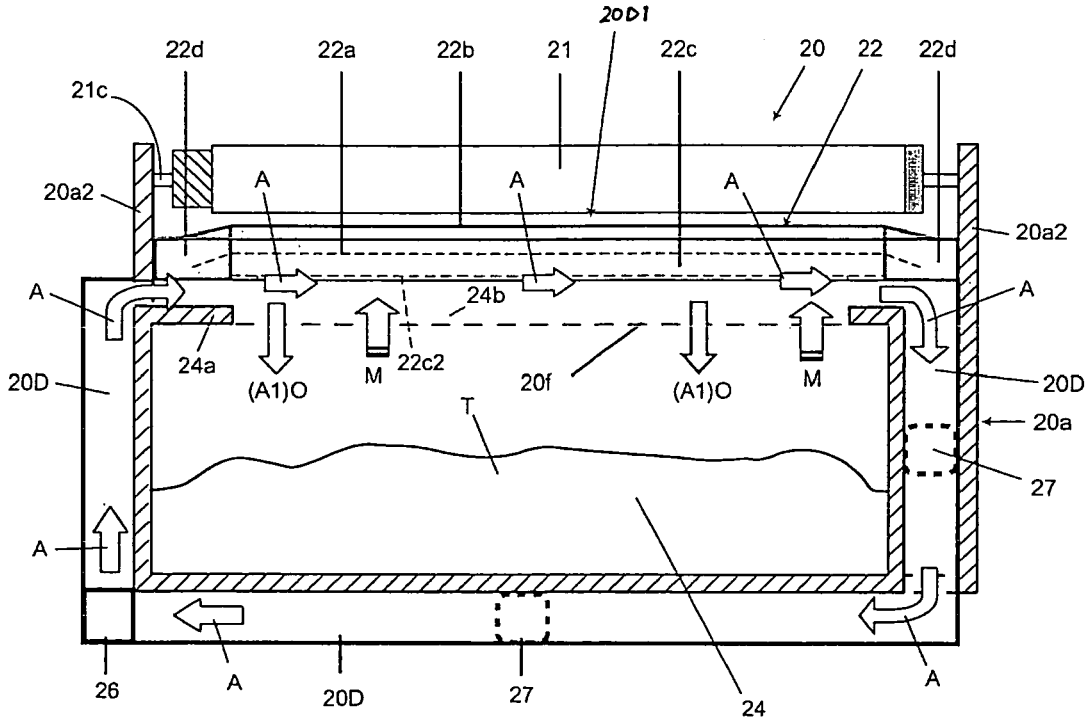
FIG. 18A is a section view of an image carrier unit according to a fourteenth embodiment of the invention.
Figure 18B:
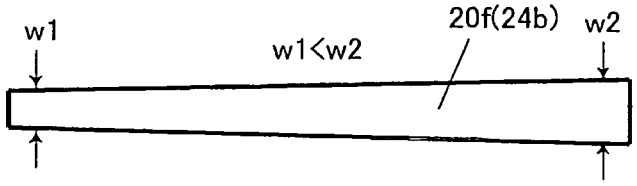
FIG. 18B is a plan view of a vent filter in the image carrier unit of FIG. 18A.

This embodiment is different from the tenth embodiment in that the width of the vent filter 20*f* is made wider in the downstream side of an air flow A than in the upstream side thereof (w2>w1 in FIG. 18B). In addition, the opening width of an opening 22*c*2 of a bottom plate 22*c*1 of a back plate 22*c* is also made wider in the downstream side of the air flow A than that in the upstream side thereof (t2>t1 in FIG. 18D).

Figure 18C:
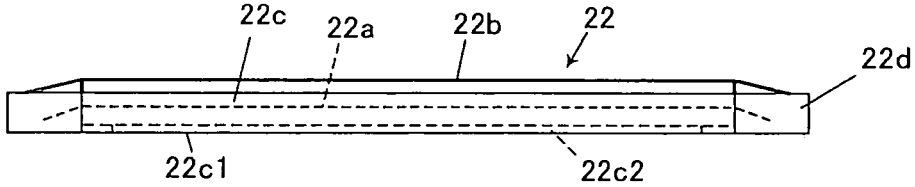
FIG. 18C is a side view of a corona charger in the image carrier unit of FIG. 18A.
Figure 18D:
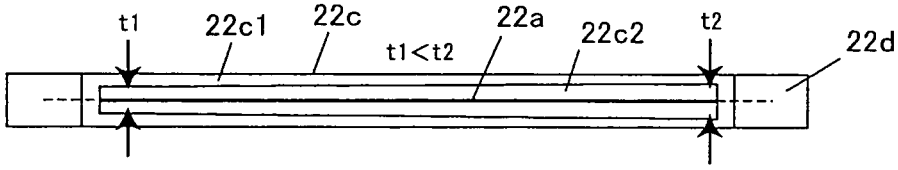
FIG. 18D is a bottom view of the corona charger of FIG. 12C.
Figure 18E:
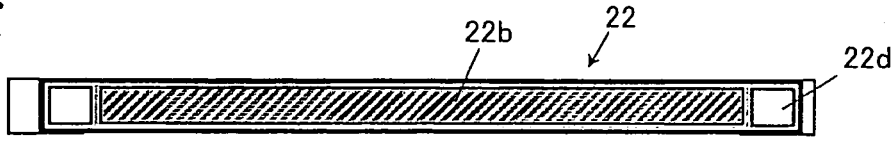
FIG. 18E is a top view of the corona charger of FIG. 12C.

As described the above, ozone is apt to stay on the downstream side of the air flow in the vicinity of the corona charger 22 (in the right side in FIGS. 18A, 18C and 18E). With the above configuration, however, the ozone which is apt to stay on the downstream side can be caused to quickly move to a waste toner storage 24 through the opening 22*c*2 and the vent filter 20*f*, and the ozone is thereby adsorbed into a waste toner T.

Figure 19:
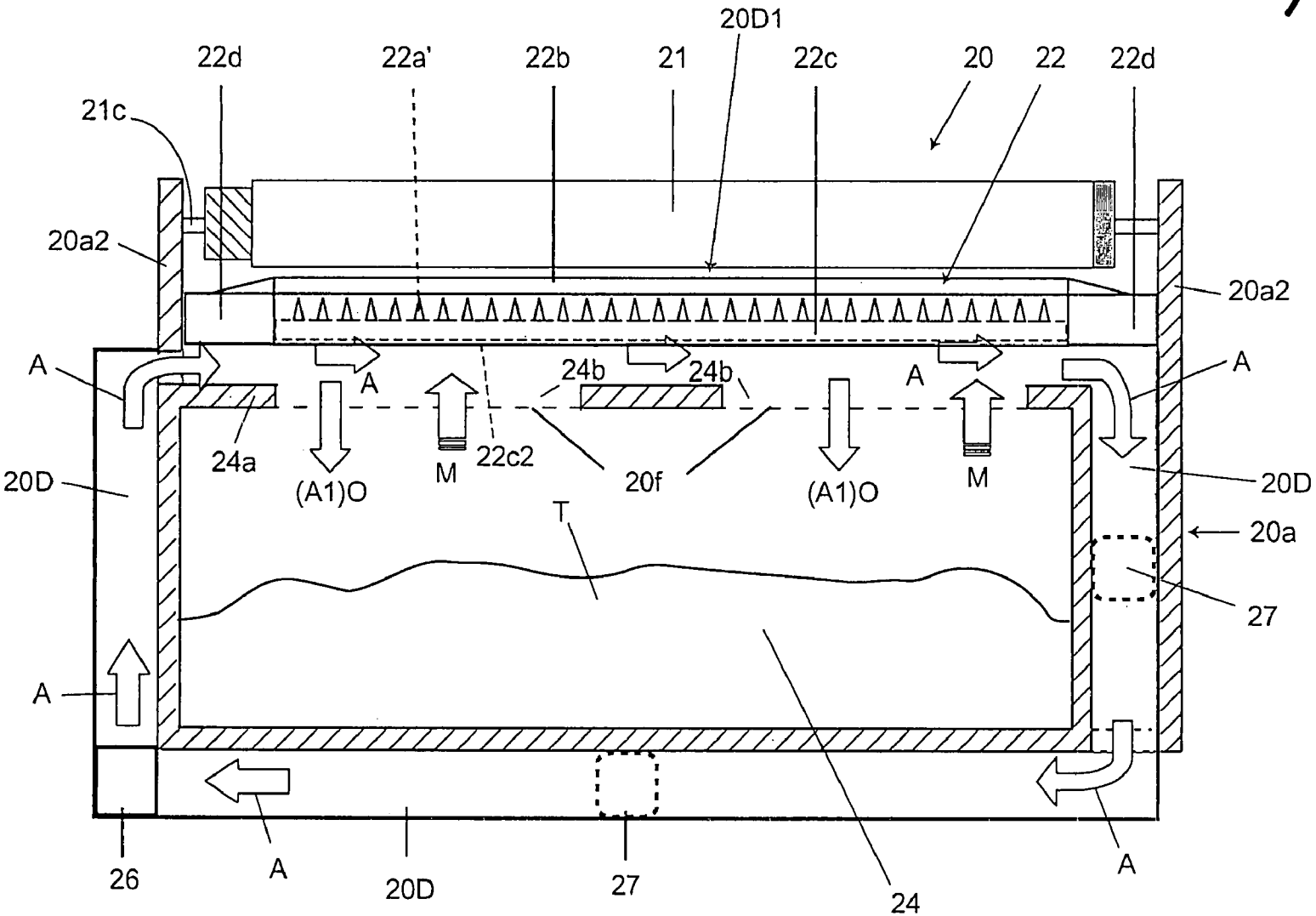
FIG. 19 is a section view of an image carrier unit according to a fifteenth embodiment of the invention.

Next, a fifteenth embodiment of the invention will be described with reference to FIG. 19. Components similar to those described in the tenth embodiment will be designated by the same reference numerals and repetitive explanations for those will be omitted.

This embodiment is different from the tenth embodiment in that a saw-toothed electrode 22*a*' is used as the discharge electrode of a corona charger 22.

By using the saw-toothed electrode 22*a*', since an ozone generation concentration (the amount of generation) is reduced, it is not necessary to provide any ozone remover 27. In the case where the ozone remover 27 is provided, a lifetime of the apparatus is prolonged.

Next, a sixteenth embodiment of the invention will be described with reference to FIGS. 20 and 21. Components similar to those described in the tenth embodiment will be designated by the same reference numerals and repetitive explanations for those will be omitted.

Figure 20:
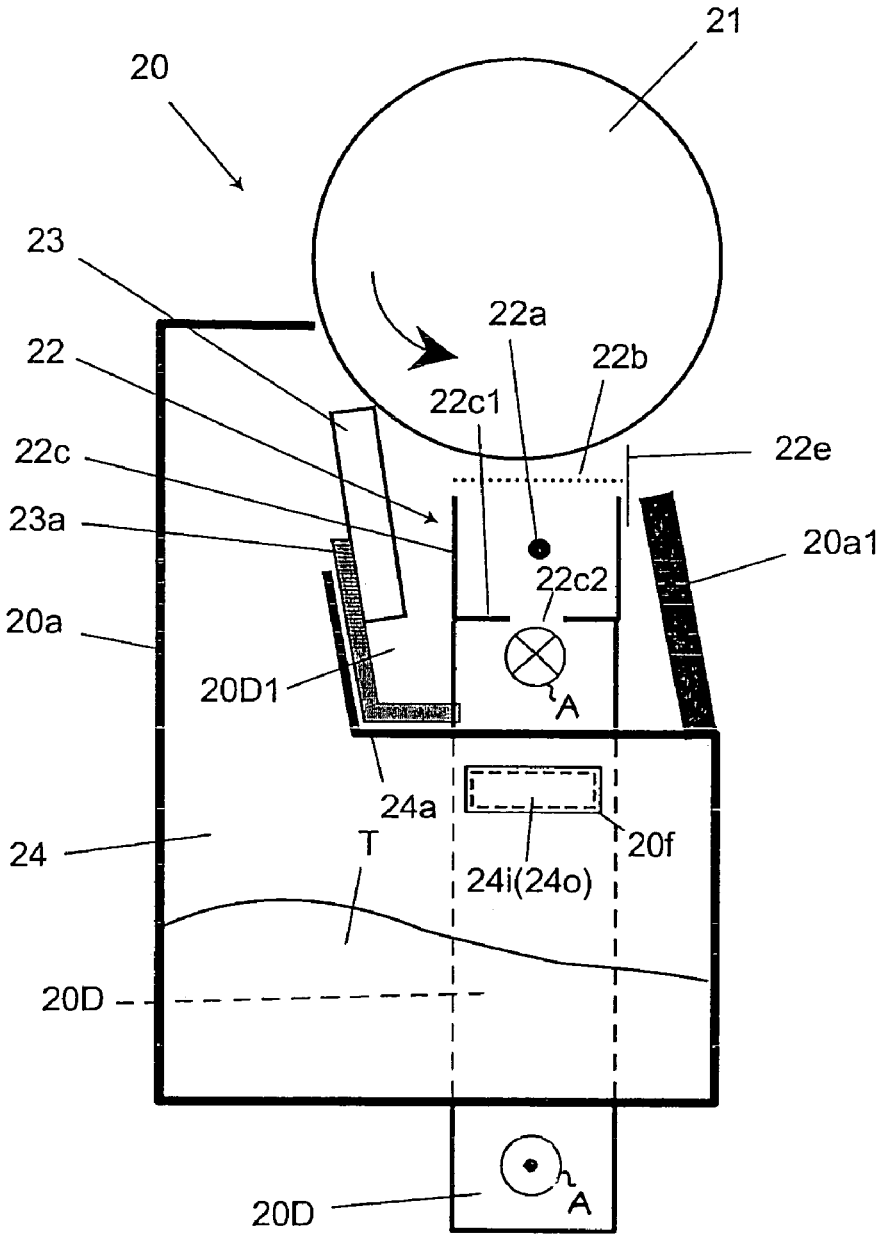
FIGS. 20 and 21 are section views of an image carrier unit according to a sixteenth embodiment of the invention.
Figure 21:
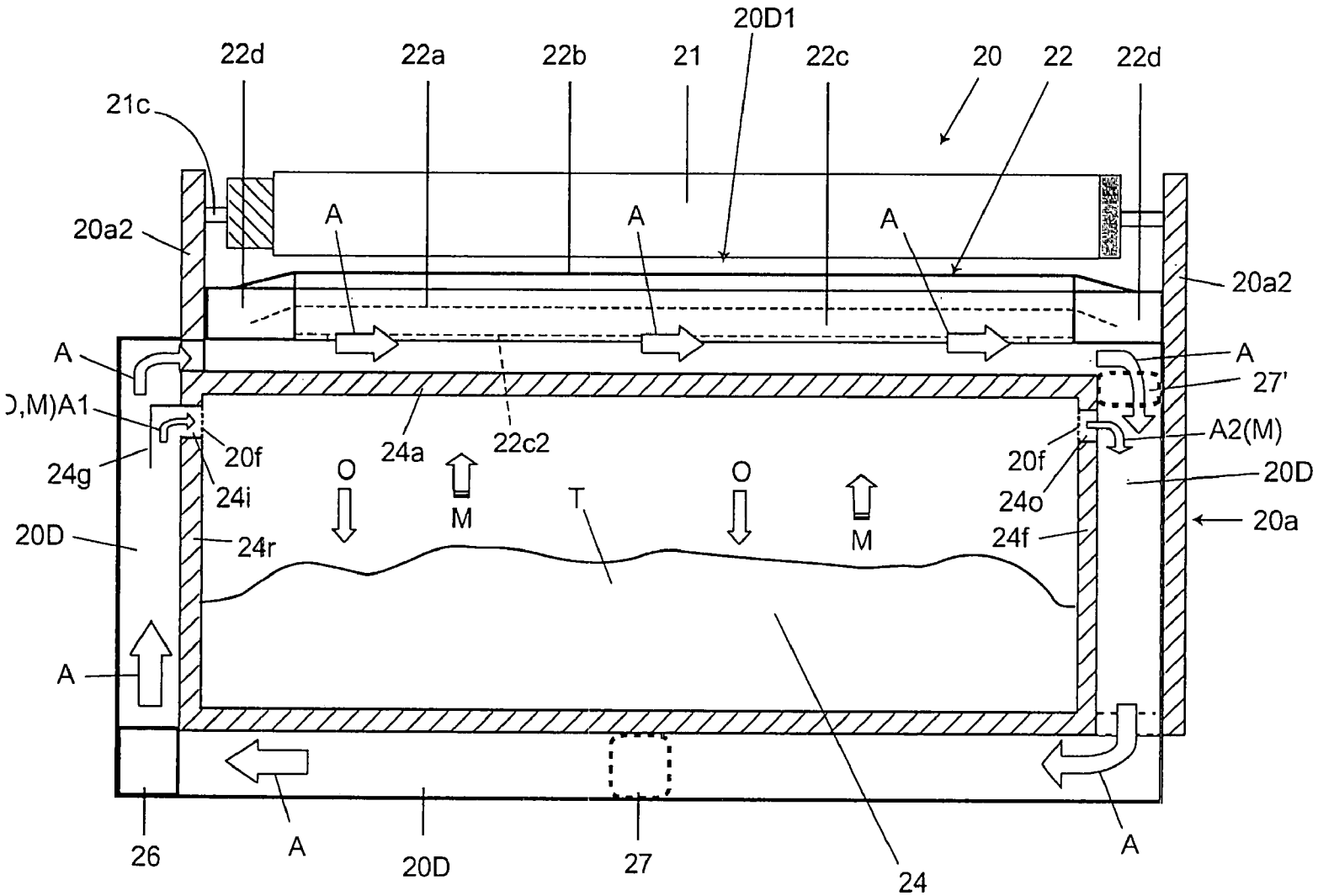

This embodiment is different from the tenth embodiment in that an air flow inlet 24*i* for causing a part A1 of an air flow A to enter the waste toner storage 24 is provided in the upper part of a rear wall 24*r* (a left side in FIG. 21) of the waste toner storage 24, and furthermore, an air flow outlet 24*o* of the waste toner storage 24 is provided in the upper part of a front wall 24*f* (a right side in FIG. 21) of the waste toner storage 24, and a vent filter 20*f* is provided to block the air flow inlet 24*i* and the air flow outlet 24*o* respectively (see FIG. 20).

The air flow inlet 24*i* and the air flow outlet 24*o* are provided in portions other than the opposed portion to the opening 22*c*2 of the back plate 22*c*. The air flow inlet 24*i* is provided with a guide 24*g* for efficiently guiding the part A1 of the air flow A into the waste toner storage 24.

The vent filter 20*f* causes the ozone to pass therethrough and does not cause the toner to pass therethrough (i.e., causes vapor or gas to pass therethrough), and the duct 20D and the waste toner storage 24 communicate with each other via the air flow inlet 24*i* and the air flow outlet 24*o* through the filter 20*f*.

With the above configuration, the ozone generated in the corona charger 22 during the image formation is circulated in the closed ventilation path, and it enters the waste toner storage 24 through the air flow inlet 24*i* and the vent filter 20*f* in the circulation process and is adsorbed into the waste toner T present in the waste toner storage 24.

In addition, since the air flow inlet 24*i* and the air flow outlet 24*o* are provided in the portions other than the opposed portion to the opening 22*c*2 of the back plate 22*c*, the air flow in the back plate 22*c* (the corona charger 22) is stabilized, thereby more stable charging condition can be obtained.

The ozone removers 27 do not need to be provided or only one of them may be provided. In the case where only one ozone remover is to be provided, it is disposed in the downstream side of the opening of the back plate 22*c*, that is, the upstream side of the air flow outlet 24*o* of the waste toner storage 24 with respect to the direction of the air flow A as indicated by the reference numeral 27'. Consequently, the ozone flowing out of the opening 22*c*2 can be removed quickly, and at the same time, the water content flowing out of the air flow outlet 24*o* can be prevented from being captured by the ozone remover 27' and the water content can be supplied quickly to the corona charger 22.

Figure 22:
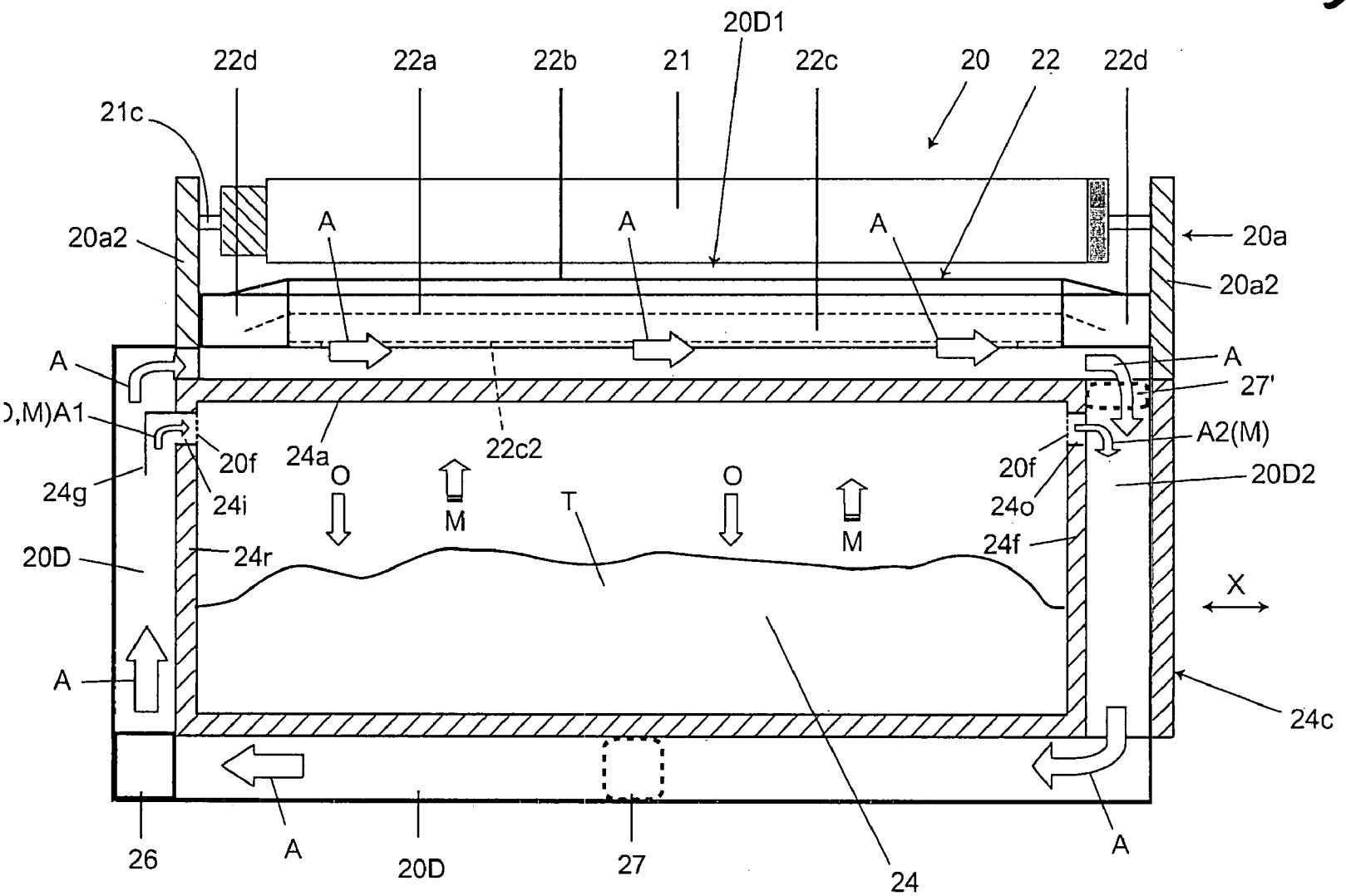
FIG. 22 is a section view of an image carrier unit according to a seventeenth embodiment of the invention.

Next, a seventeenth embodiment of the invention will be described with reference to FIG. 22. Components similar to those described in the sixteenth embodiment will be designated by the same reference numerals and repetitive explanations for those will be omitted.

This embodiment is different from the sixteenth embodiment in that a waste toner storage 24 is constituted to be solely replaceable and a vent filter 20*f* and an ozone remover 27' is provided in the water toner storage 24.

The waste toner storage 24 is constituted by an independent casing 24*c* and adapted to be moved in the direction of arrows X relative to a casing 20*a* of the image carrier unit 20. The ozone remover 27' is disposed within a part 20D2 in the duct 20D.

Openings 24*d* are provided in a portion of the casing 24*c* which is opposed to an opening 24*b*, and the vent filter 20*f* is provided to close the opening 24*d* on the internal face side of the casing 24*c*.

In the case where the waste toner storage 24 is constituted to be solely replaceable, thus, the vent filter 20*f* is provided in the waste toner storage 24. Consequently, the vent filter 20*f* can be periodically replaced in accordance with the replacement of the waste toner storage 24, so that an almost constant vent efficiency can be maintained.

Moreover, the waste toner storage 24 and the part 20D2 of the duct 20D are constituted to be solely replaceable. Consequently, the ozone remover 27' can be replaced periodically and an almost constant ozone removing efficiency can be maintained.

The above configuration is advantageous in a such a structure that excellent durability is given to a photosensitive body 21 and a corona charger 22 and the large volume of the waste toner storage 24 cannot be secured. In other words, with such a structure, it is possible to reduce the size of the waste toner storage 24 (therefore, to reduce the size of the whole image forming apparatus).

Figure 23:
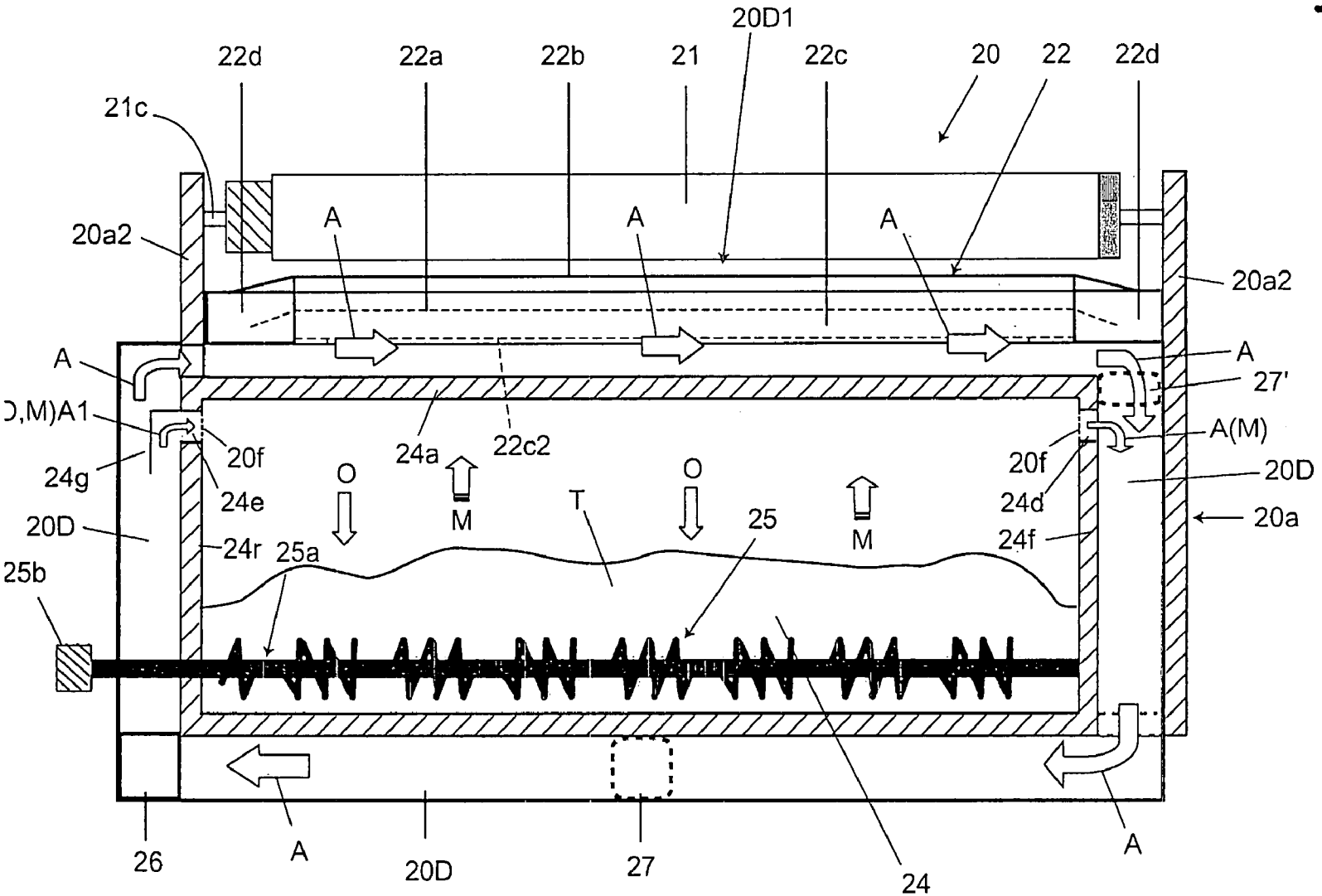
FIG. 23 is a section view of an image carrier unit according to an eighteenth embodiment of the invention.

Next, an eighteenth embodiment of the invention will be described with reference to FIG. 23. Components similar to those described in the sixteenth embodiment will be designated by the same reference numerals and repetitive explanations for those will be omitted.

This embodiment is different from the sixteenth embodiment in that an agitator 25 for agitating waste toner T is provided in a waste toner storage 24. The agitator 25 is provided with a delivery member for delivering the waste toner.

The agitator 25 has a shaft 25*a* rotatably supported by a casing 20*a* and a gear 25*b* provided on one of the ends of the shaft 25*a* is engaged with a gear (not shown) provided on the body side of the apparatus to rotate the shaft 25*a*.

Thus, the waste toner storage 24 is provided with the agitator 25 for agitating the waste toner T. Consequently, it is possible to renew the surface of the waste toner T in the storage 24. Thus, it is possible to obtain ozone adsorbing effect and a water content adsorbing and releasing effect efficiently and continuously.

Figure 24:
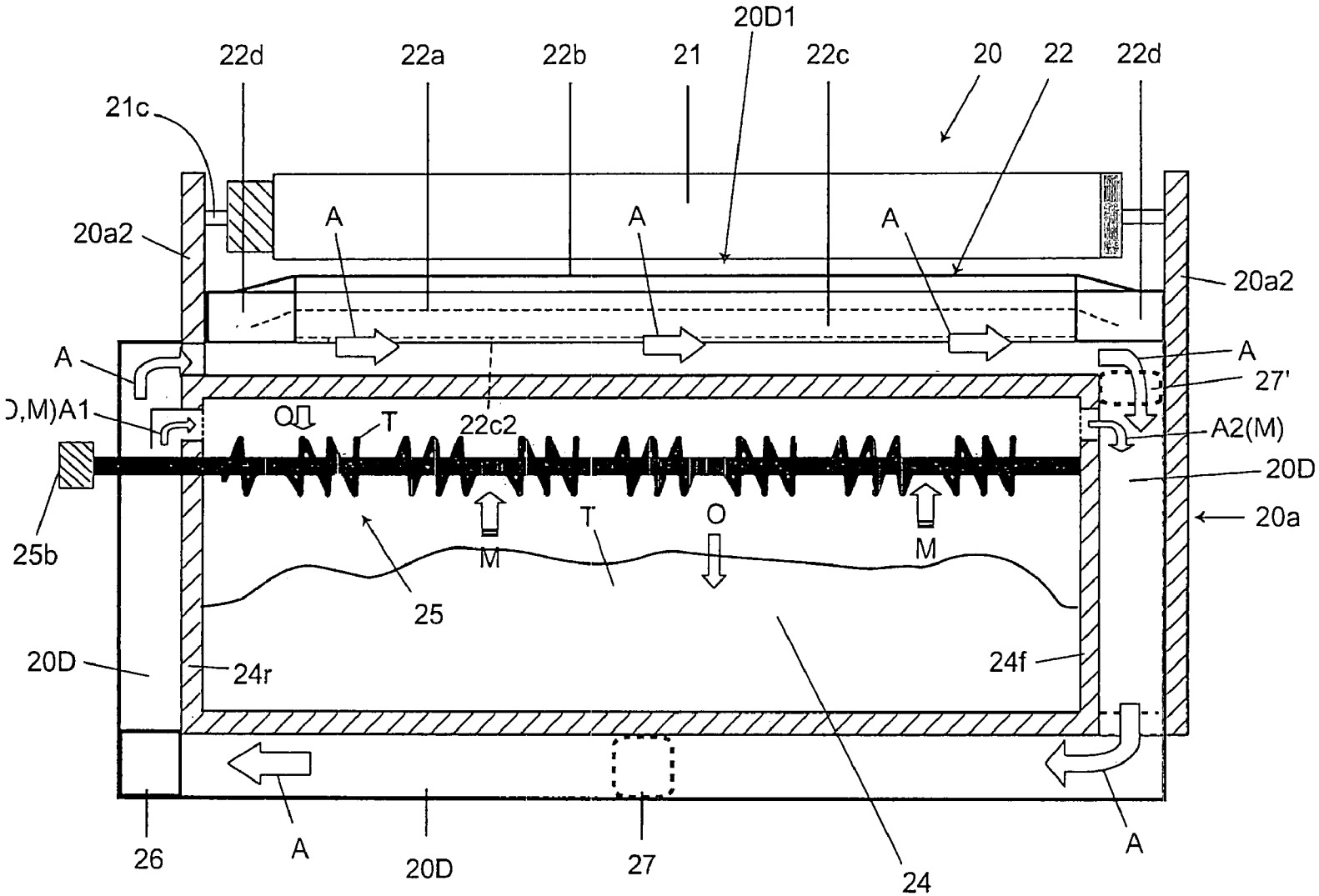
FIG. 24 is a section view of an image carrier unit according to a nineteenth embodiment of the invention.

Next, a nineteenth embodiment of the invention will be described with reference to FIG. 24. Components similar to those described in the sixteenth embodiment will be designated by the same reference numerals and repetitive explanations for those will be omitted.

This embodiment is different from the eighteenth embodiment in that a agitator 25 is provided in the vicinity of a vent filter 20*f*. Consequently, ozone passing through the vent filter 20*f* can be adsorbed more quickly by waste toner T stuck to the agitator 25.

Next, a twentieth embodiment of the invention will be described with reference to FIGS. 25A to 25D. Components similar to those described in the sixteenth embodiment will be designated by the same reference numerals and repetitive explanations for those will be omitted.

Figure 25A:
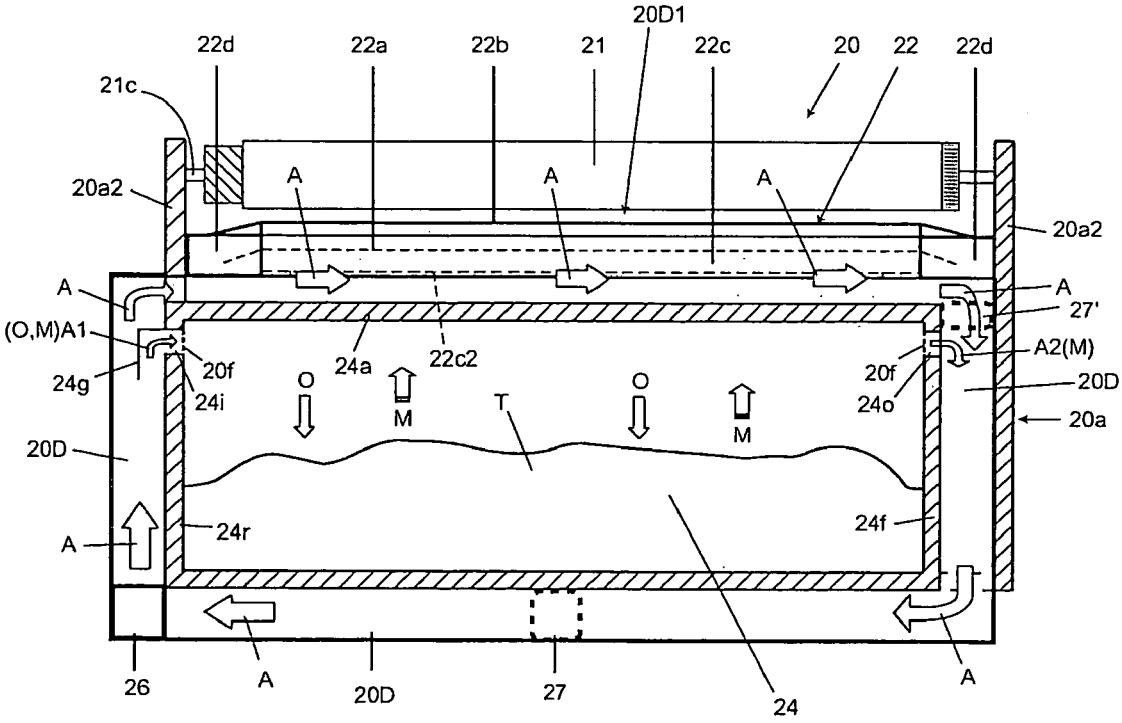
FIG. 25A is a section view of an image carrier unit according to a twentieth embodiment of the invention.
Figure 25B:
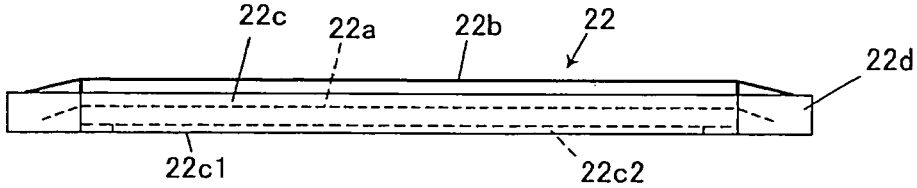
FIG. 25B is a side view of a corona charger in the image carrier unit of FIG. 25A.
Figure 25C:
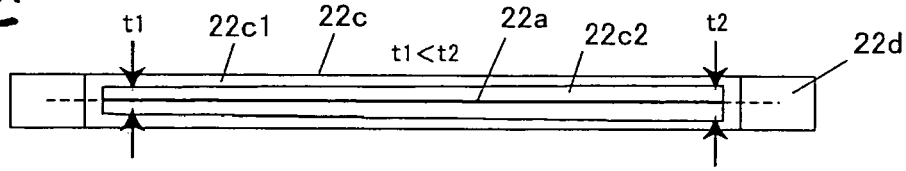
FIG. 25C is a bottom view of the corona charger of FIG. 25B.

This embodiment is different from the sixteenth embodiment in that the opening width of an opening 22*c*2 of a bottom plate 22*c*1 of a back plate 22*c* is also made wider in the downstream side of the air flow A than that in the upstream side thereof (t2>t1 in FIG. 25C).

Figure 25D:
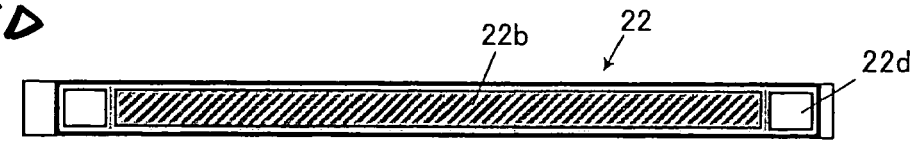
FIG. 25D is a top view of the corona charger of FIG. 25B.

As described the above, ozone is apt to stay on the downstream side of the air flow in the vicinity of the corona charger 22 (in the right side in FIGS. 25A, 25B and 25D). With the above configuration, however, the ozone which is apt to stay on the downstream side can be caused to quickly move to a waste toner storage 24 through the opening 22*c*2 and the vent filter 20*f*, and the ozone is thereby adsorbed into a waste toner T.

Figure 26:
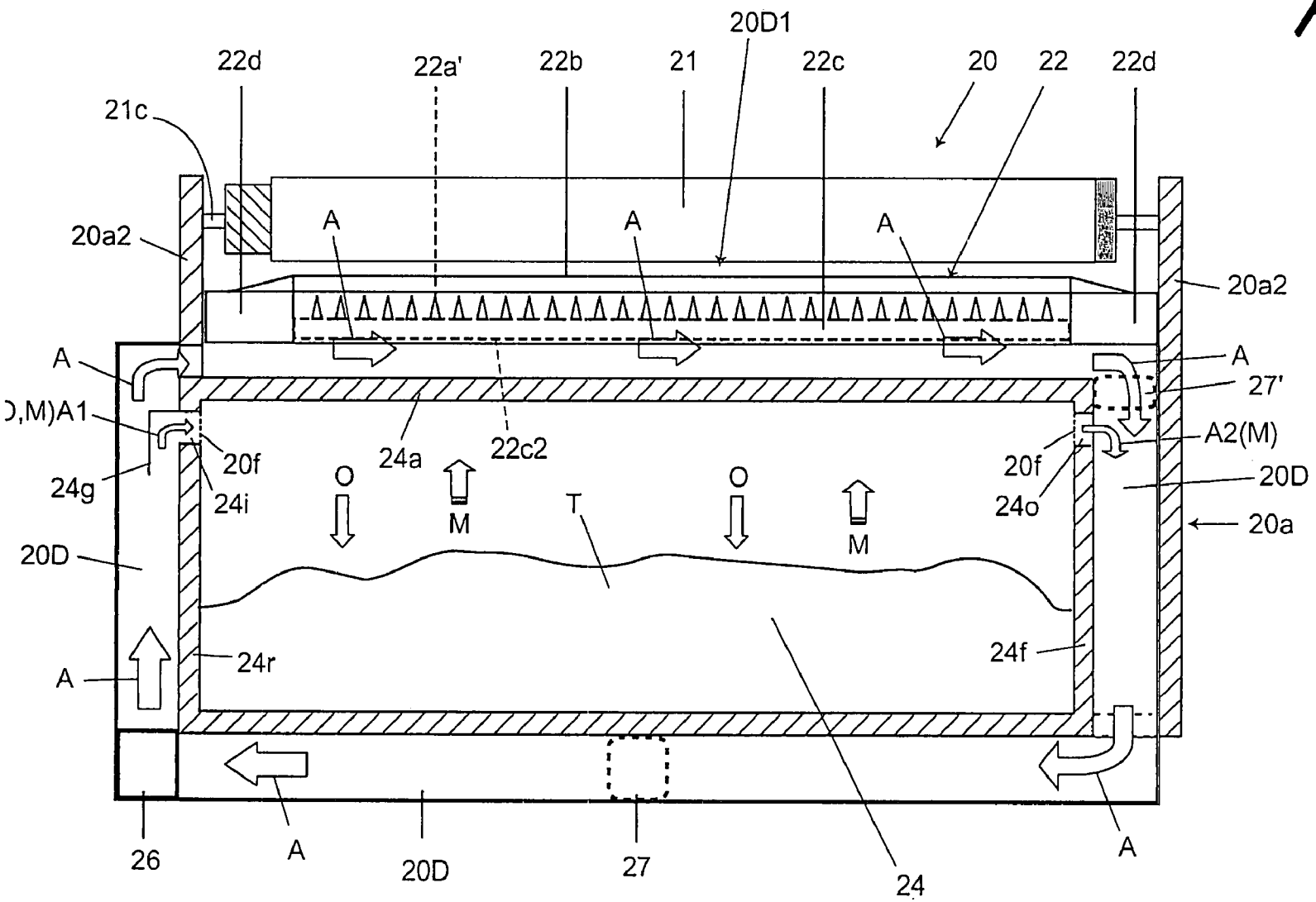
FIG. 26 is a section view of an image carrier unit according to a twenty-first embodiment of the invention.

Next, a twenty-first embodiment of the invention will be described with reference to FIG. 26. Components similar to those described in the sixteenth embodiment will be designated by the same reference numerals and repetitive explanations for those will be omitted.

This embodiment is different from the sixteenth embodiment in that a saw-toothed electrode 22*a*' is used as the discharge electrode of a corona charger 22.

By using the saw-toothed electrode 22*a*', since an ozone generation concentration (the amount of generation) is reduced, it is not necessary to provide any ozone remover 27. In the case where the ozone remover 27 is provided, a lifetime of the apparatus is prolonged.

Next, a twenty-second embodiment of the invention will be described with reference to FIG. 27. Components similar to those described in the sixteenth embodiment will be designated by the same reference numerals and repetitive explanations for those will be omitted.

This embodiment is different from the sixteenth embodiment described above in that an opening 22*c*3 is provided only front and rear parts (on left and right parts in FIG. 27) in a bottom plate 22*c*1 of a back plate 22*c* and in that an air flow inlet 24*i* and an air flow outlet 24*o* are provided in a part of a top plate portion 24*a* of a waste toner storage 24 which is not opposed to the opening 22*c*3. The air flow inlet 24*i* and the air flow outlet 24*o* are blocked by the vent filter 20*f*, respectively.

Figure 27:
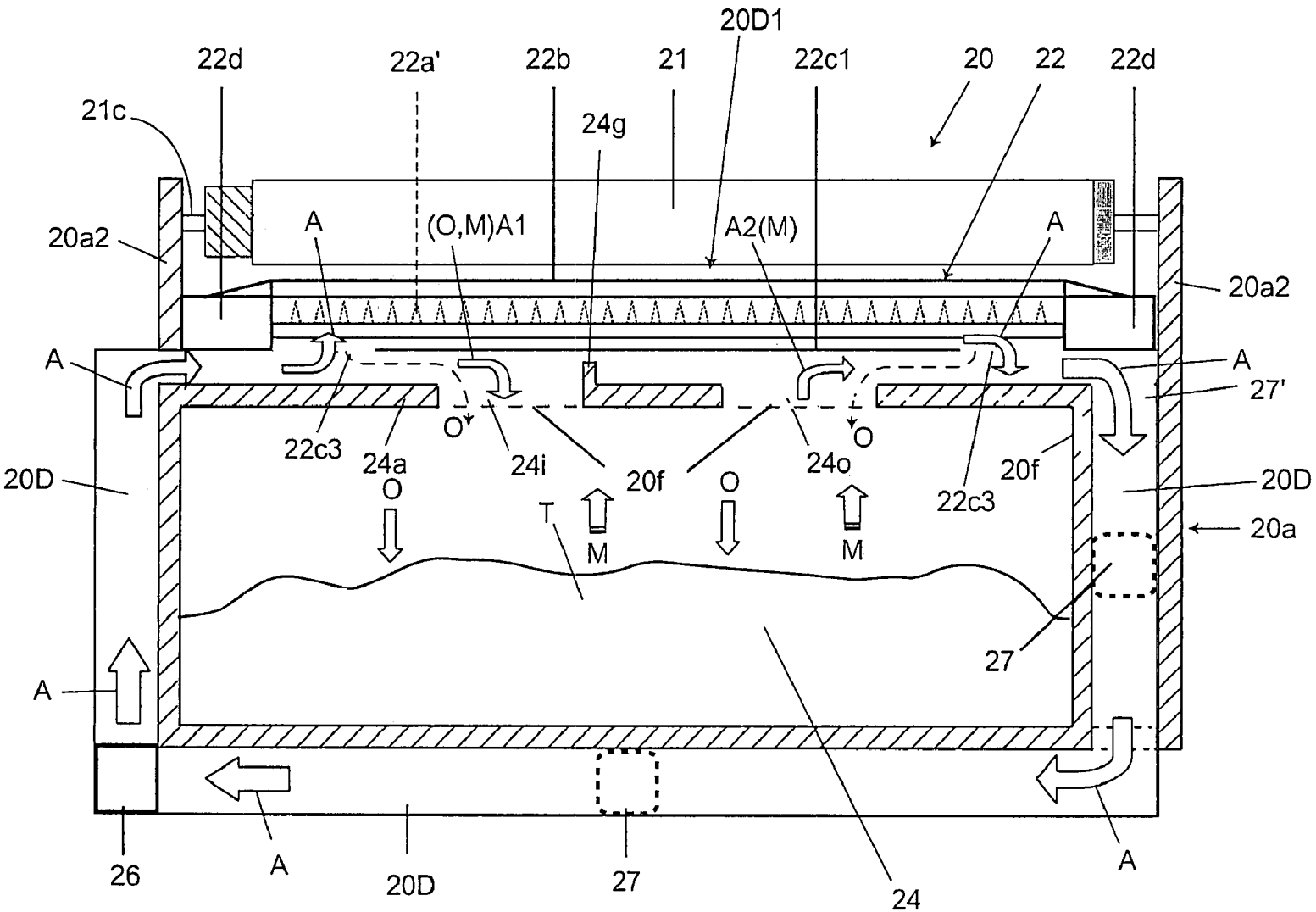
FIG. 27 is a section view of an image carrier unit according to a twenty-second embodiment of the invention.

With the above configuration, in the case where the air flow generator 26 is deactivated after the image formation, ozone generated by the image formation moves downward by self-weight thereof to the waste toner storage 24 by way of the opening 22*c*3 and the vent filter 20*f* as shown in dashed lines O in FIG. 27.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

an image carrier, on which an electrostatic latent image and a toner image are to be formed;

a corona charger, comprising:

a discharge electrode, which uniformly charges a surface of the image carrier; and a back plate, which defines a first space which surrounds the discharge electrode while opening a side that the discharge electrode faces the image carrier, the back plate being formed with a first opening;

a storage, having a second space which stores waste toner generated in the image forming apparatus, the storage being formed with a second opening; and a filter, which causes ozone to pass through but blocks toner, the filter being disposed between the corona charger and the second space;

wherein the first space and the second space are communicated by way of the first opening and the second opening.

2. The image forming apparatus as set forth in claim 1, wherein the storage is arranged below the corona charger, and the corona charger is arranged below the image carrier.

3. The image forming apparatus as set forth in claim 1, wherein the image carrier, the corona charger and the storage are integrated in a single cartridge body.

4. The image forming apparatus as set forth in claim 1, wherein:

the storage is configured to be replaceable independently from the image carrier and the corona charger; and the filter is disposed so as to close the second opening.

5. The image forming apparatus as set forth in claim 1, further comprising an agitator disposed in the storage to agitate the waste toner stored therein.

6. The image forming apparatus as set forth in claim 5, wherein the agitator is disposed in the vicinity of the second opening.

7. The image forming apparatus as set forth in claim 1, and further comprising:

a duct, in which the corona charger is disposed, the duct being formed with a third opening; and an air flow generator, which generates air flow in the duct, wherein: the duct and the second space are communicated by way of the second opening and the third opening; and the filter is disposed between the duct and the second space.

8. The image forming apparatus as set forth in claim 7, wherein the storage is arranged below the duct.

9. The image forming apparatus as set forth in claim 7, wherein:

the filter is elongated in a direction of the air flow; and a dimension of the filter in a direction perpendicular to the direction of the air flow is made larger in a downstream side of the air flow.

10. The image forming apparatus as set forth in claim 9, wherein:

the first opening is elongated in the direction of air flow; and a dimension of the first opening in the direction perpendicular to the direction of the air flow is made larger in a downstream side of the air flow.

11. The image forming apparatus as set forth in claim 7, wherein the duct is configured to form a closed circulation path.

12. The image forming apparatus as set forth in claim 11, further comprising an ozone remover disposed in the duct.

13. The image forming apparatus as set forth in claim 1, wherein the discharge electrode is a saw-toothed electrode.

14. The image forming apparatus as set forth in claim 11, wherein the second opening and the third opening are arranged so as not to oppose to the first opening.

15. The image forming apparatus as set forth in claim 1, wherein the second opening is arranged so as to oppose to the first opening.

* * * * *